US007009146B2

(12) United States Patent
Torigoe

(10) Patent No.: US 7,009,146 B2
(45) Date of Patent: Mar. 7, 2006

(54) HEAT EXCHANGER FOR HEATING, AND AIR CONDITIONER FOR VEHICLE USE

(75) Inventor: Eiichi Torigoe, Anjo (JP)

(73) Assignee: DENSO Corporation, Kariya (JP)

( * ) Notice: Subject to any disclaimer, the term of this patent is extended or adjusted under 35 U.S.C. 154(b) by 74 days.

(21) Appl. No.: 10/862,854

(22) Filed: Jun. 7, 2004

(65) Prior Publication Data

US 2004/0251244 A1 Dec. 16, 2004

(30) Foreign Application Priority Data

Jun. 10, 2003 (JP) ..... 2003-165113

(51) Int. Cl.
*B60L 1/02* (2006.01)

(52) U.S. Cl. ..... 219/206; 219/202; 392/485

(58) Field of Classification Search ..... 219/206, 219/202, 203, 208, 504, 532, 536, 537, 540; 392/485; 165/299, 300, 41
See application file for complete search history.

(56) References Cited

U.S. PATENT DOCUMENTS

| | | | | |
|---|---|---|---|---|
| 3,651,304 A | * | 3/1972 | Fedor | 219/200 |
| 3,721,800 A | * | 3/1973 | Eisler | 219/213 |
| 3,835,435 A | * | 9/1974 | Seel | 338/280 |
| 3,852,567 A | * | 12/1974 | Michaud et al. | 392/357 |
| 3,852,568 A | * | 12/1974 | Clement | 338/283 |
| 4,963,716 A | * | 10/1990 | Van Den Elst et al. | 219/202 |
| 5,187,349 A | * | 2/1993 | Curhan et al. | 219/202 |
| 5,206,476 A | * | 4/1993 | Fresch et al. | 219/202 |
| 5,239,163 A | * | 8/1993 | Brouwers | 219/202 |
| 6,040,557 A | * | 3/2000 | Prust et al. | 219/206 |
| 6,047,769 A | | 4/2000 | Shimoya et al. | |
| 6,242,712 B1 | * | 6/2001 | Prust | 219/206 |
| 6,265,692 B1 | * | 7/2001 | Umebayahi et al. | 219/202 |
| 6,832,648 B1 | * | 12/2004 | Torigoe et al. | 165/148 |

FOREIGN PATENT DOCUMENTS

| | | |
|---|---|---|
| JP | 63-203411 | 8/1988 |
| JP | 11-287580 | 10/1999 |

* cited by examiner

*Primary Examiner*—Robin O. Evans
*Assistant Examiner*—Vinod Patel
(74) *Attorney, Agent, or Firm*—Harness, Dickey & Pierce, PLC

(57) ABSTRACT

A heat exchanger for heating comprises a plurality of heat transfer plate members (34) arranged in parallel with each other at predetermined intervals; and connecting portions (35, 36) for integrally connecting the plurality of heat transfer plate members (34) to each other, wherein air passages (37) are formed between the plurality of heat transfer plate members (34), inner fluid passages (31) are formed in the heat transfer plate members (34), fluid, for heating air which passes in the air passages (37), flows in the inner fluid passages (31), and an electric heat generating film (40), for heating the air which passes in the air passages (37), is formed on surfaces of the plurality of heat transfer plate members (34).

16 Claims, 15 Drawing Sheets

HEAT EXCHANGER FOR HEATING, AND AIR CONDITIONER FOR VEHICLE USE

BACKGROUND OF THE INVENTION

1. Field of the Invention

The present invention relates to a heat exchanger, for heating, provided with an electric heating unit structure in which heat is generated when the electric heating unit is electrically energized. The present invention also relates to an air conditioner for vehicle use into which the heat exchanger for heating is incorporated.

2. Description of the Related Art

Concerning the air conditioner for vehicle use, it is well known that an immediate heating effect can be exhibited when an electric heater is incorporated into the heat exchanger for heating.

The constitution of this prior art is described as follows. A heat exchange core portion of the heat exchanger for heating is composed of flat tubes, in which hot water (engine coolant) flows, and corrugated fins, wherein the flat tubes and the corrugated fins are laminated on each other. In a portion of this heat exchange core portion, flat tubes, to which an electric heater is attached, are provided. To be more specific, instead of the flat tubes in which hot water flows, flat tubes, to which an electric heater is attached, are provided, and the electric heater is attached to these flat tubes.

When the temperature of hot water (engine coolant) is low immediately after the vehicle engine has been started, the electric heater is energized, and heat generated by the electric heater is emitted into the air passing through the heat exchange core portion so that an immediate heating effect can be exhibited.

In this connection, the flat tubes and the corrugated fins composing the heat exchange core portion of the heat exchanger for heating are made of metal such as aluminum, the heat conductivity of which is high. Therefore, heat generated by the electric heater is conducted from the electric heater to the adjoining flat tubes, in which hot water flows, via the corrugated fins. Further, the heat is conducted to the water at low temperature flowing in the flat tubes.

As a result, it is impossible to effectively transmit the heat, which has been generated by the electric heater, to the air. Therefore, even when electric power is consumed by the electric heater, the efficiency of the immediate heating effect is deteriorated.

According to the aforementioned prior art, the electric heater is electrically energized via the heat exchange core portion by utilizing the heat exchange core portion, made of aluminum, as a conductor. Therefore, electrolytic corrosion occurs in the flat tubes and the corrugated fins.

When the heat exchanger is put into practical use, in order to ensure corrosion resistance of the heat exchanger, it is indispensable that the electric heater is attached to the heat exchanger core portion but is electrically insulated from the core portion. Therefore, the structure of the heat exchanger becomes complicated, which causes an increase in the manufacturing cost.

SUMMARY OF THE INVENTION

In view of the above problems of the prior art, an object of the present invention is to provide a heat exchanger for heating, the immediate heating effect of which is high, and the structure of which is simple.

In order to accomplish the above object, according to a first aspect of the present invention, there is provided a heat exchanger for heating comprising: a plurality of heat transfer plate members (34) arranged in parallel with each other at predetermined intervals; and connecting portions (35, 36) for integrally connecting the plurality of heat transfer plate members (34) to each other, wherein air passages (37) are formed between the plurality of heat transfer plate members (34), inner fluid passages (31) are formed in the heat transfer plate members (34), fluid for heating air, which passes in the air passages (37), flows in the inner fluid passages (31), and an electric heat generating film (40) for heating the air, which passes in the air passages (37), by energizing is formed on surfaces of the plurality of heat transfer plate members (34).

Due to the constitution of the present invention, heat transfer plate members (34), in which inner fluid passages (31) are formed, are made of an electrically insulating material. As the heat conductivity of an electrically insulating material is much lower than that of a metallic material, in the case of the immediately effective heating in which air passing in the air passage (37) is heated by the heat generated by the electric heating film (40), the heat generated by the electric heat generating film (40) can be suppressed from being transferred to the fluid at low temperature (water at low temperature) flowing in the inner fluid passage (31). Therefore, the immediately effective heating can be effectively executed by the heat generated by the electric heat generating film (40).

As the heat transfer plate members (34) are made of an electrically insulating material, no problems of electrolytic corrosion occur in the heat transfer plate members (34). Accordingly, it is unnecessary to provide an electrically insulating structure for avoiding the problems of electrolytic corrosion. Therefore, the electric heating films (40) can be directly formed on the surface of the heat transfer plate members (34). Due to the foregoing, the structure of the heat exchanger can be simplified and, further, the heat transfer plate members (34) and the connecting portions (35, 36) can be simply formed by means of integral molding. Accordingly, it becomes possible to cheaply provide a compact, light heat exchanger for heating.

According to a second aspect of the present invention, the heat transfer plate members (34) and the connecting portions (35, 36) are formed of an electrically insulating material by means of integral molding.

According to a third aspect of the present invention, each heat transfer plate member (34) includes protruding portions **(34*a*, 34*b*) which protrude from both faces of the heat transfer plate member (34), the inner fluid passages (31) are formed inside the protruding portions (34*a*, 34*b*), the protruding portions (34*a*, 34*b*) and the inner fluid passages (31) are formed in a direction perpendicular to the air flow direction (a) of the air passages (37), a plurality of protruding portions (34*a*, 34*b*) and inner fluid passages (31) are formed being arranged in the air flow direction (a), and the air passages (37) are formed into a meandering shape by the protruding portions (34***a*, 34*b*).

Due to the above constitution, turbulent flows are caused by the protrusions (34*a*, 34*b*) of the heat transfer plate members (34), and the heat conductivity on the air side can be enhanced. Therefore, even in a finless structure in which no fins are combined with the heat transfer plate members (34), it is possible to ensure the necessary heating performance in the case of the immediately effective heating, in which the heat generated by the electric heat generating film (40) is used as a heat source, and in the case of the normal heating in which the fluid for heating in the inner fluid passage (31) is used as a heat source.

According to a fourth aspect of the present invention, the air passages (37) are formed into a meandering shape when the protruding portions (34*a*, 34*b*) protrude in the lateral direction with respect to the air flow direction.

According to a fifth aspect of the present invention, the electric heat generating film (40) may be formed in all regions on the heat transfer plate member (34) in the air flow direction (a).

According to a sixth aspect of the present invention, the electric heat generating film (40) may be formed only in a region of the heat transfer plate member (34) in the air flow direction (a).

According to a seventh aspect of the present invention, a region, in which the inner fluid passages (31) are not formed, may be provided in a portion of the heat transfer plate member (34) in the air flow direction (a), and the electric heat generating film (40) may be formed only in a region of the heat transfer plate member (34) in which the inner fluid passages (31) are not formed.

Due to the foregoing, in the case of the immediately effective heating, in which the heat generated by the electric heat generating film (40) is used as a heat source, it is possible to positively prevent the heat generated by the electric heat generating film (40) from being transferred to the fluid at low temperature flowing in the inner fluid passage (31). Accordingly, the efficiency of the immediately effective heating by the heat generated by the electric heat generating film (40) can be further enhanced.

According to an eighth aspect of the present invention, a large number of heat transfer plate members (34) are arranged in parallel to each other, and the electric heat generating film (40) may be formed on surfaces of the heat transfer plate members (34) arranged at predetermined intervals.

According to a ninth aspect of the present invention, the wall thickness of the heat transfer plate member (34) in the periphery of the inner fluid passage (31) is 0.1 to 0.4 mm, and the heat conductivity of the electrically insulating material is 0.6 to 10 W/mK.

According to investigations made by the present inventors, the following were confirmed as exemplarily shown in FIG. 7. When the thickness of the heat transfer plate member (34) in the periphery of the inner fluid passage (31) was no more than 0.4 mm and the heat conductivity of the heat transfer plate member (34) was not less than 0.6 W/mK, even if the heat transfer plate member (34) was made of an electrically insulating material, the heating performance in the case of normal heating was deteriorated only a little compared with the case in which the heat transfer plate member (34) was made of aluminum.

In this connection, in order to suppress the heat transfer to the heating fluid at low temperature at the time of the immediately effective heating, it is preferable that the upper limit of the heat conductivity of the heat transfer plate member (34) is not more than 10 W/mK.

Further, in order ensure the mechanical strength for withstanding pressure in the inner fluid passage (31), it is preferable that the lower limit of the thickness of the heat transfer plate member (34) is not less than 0.1 mm.

According to a tenth aspect of the present invention, there is provided a heat exchanger for heating comprising: a plurality of heat transfer plate members (34) arranged in parallel with each other at predetermined intervals; and connecting portions (35, 36) for integrally connecting the plurality of heat transfer plate members (34) to each other, wherein the heat transfer plate members (34) and the connecting portions (35, 36) are formed of an electrically insulating material by means of integral molding, the air passages (37) are formed between the plurality of heat transfer plate members (34), the heat transfer plate members (34) are formed into a solid plate-shape, and an electric heat generating film (40) for heating the air, which passes in the air passages (37), is formed on surfaces of the plurality of heat transfer plate members (34).

The points of the tenth aspect of the present invention different from the first aspect are that the heat transfer plate member (34) is formed into a solid plate shape and the inner fluid passage (31) is not provided in the heat transfer plate member (34). Accordingly, the heat exchanger for heating of the tenth aspect is exclusively used for electrical heating in which only the heating action is exhibited by the heat generated by the electric heat generating film (40).

In the same manner as that of the first aspect, in the tenth aspect of the present invention, no problems of electrolytic corrosion occur in the heat transfer plate member (34). Therefore, the electric heating films (40) can be directly formed on the surface of the heat transfer plate members (34). Due to the foregoing, the structure of the heat exchanger can be simplified and, further, the heat transfer plate members (34) and the connecting portions (35, 36) can be simply formed by means of integral molding. Accordingly, it becomes possible to cheaply provide a compact, light heat exchanger for heating.

As in the eleventh aspect, specifically, it is preferable that the heat insulating material is a heat-resistant resin capable of withstanding the temperature of the electric heat generating film (40) when it is heated. Due to the foregoing, even the complicated lamination structure of the heat transfer plate member (34) can be easily formed by means of integral molding by utilizing the excellent molding property of a resin material.

According to a twelfth aspect of the present invention, at least two connecting members (35, 36) are arranged for the plurality of heat transfer plate members (34), the electric heat generating film (40) is continuously formed on a surface from the plurality of heat transfer plate members (34) to at least two connecting portions (35, 36), and the terminal portions (41, 41*a* to 41*d*, 42) for energizing the electric heat generating film (40) are connected to the electric heat generating film (40) on at least two connecting portions (35, 36).

Due to the foregoing, at least two connecting portions (35, 36), by which a plurality of heat transfer plate members (34) are connected being integrated into one body, can be effectively utilized as they are, and the terminal portions (41, 41*a* to 41*d*, 42), which are used for energizing the electric heat generating film (40), can be simply provided.

According to a thirteenth aspect of the present invention, the electric heat generating film (40) is formed on surfaces of the plurality of heat transfer plate members (34) being divided into a plurality of regions, and the electric heat generating films (40) provided on the plurality of regions are respectively controlled capable of being independently energized.

Due to the foregoing, the generation of heat by the electric heat generating film (40) in a plurality of regions can be independently controlled. Therefore, temperatures of the air passing in the air passages (37) in the plurality of regions can be independently controlled to be different temperatures.

According to a fourteenth aspect of the present invention, there is provided a heat exchanger for heating, further comprising: a temperature detection means (44*a*) for detecting a surface temperature of the electric heat generating film (40); and a control means (43) for controlling an electric current supplied to the electric heat generating film (40) according to the detection temperature detected by the temperature detection means (44*a*).

Due to the foregoing, the surface temperature of the electric heat generating film (40) can be automatically controlled to be not more than the upper limit temperature. Therefore, it is possible to previously prevent the electric heat generating film (40) from being overheated.

According to a fifteenth aspect of the present invention, there is provided an air conditioner for vehicle use comprising a heat exchanger for heating according to the first to the ninth aspects, wherein the fluid for heating is not water supplied from a hot water source mounted on a vehicle, and the electric heat generating film (40) is energized when the temperature of the hot water is not more than a predetermined temperature.

Due to the foregoing, it is possible to exhibit the operational effect of the first to the ninth aspects in the air conditioner for vehicle use.

According to a sixteenth aspect of the present invention, there is provided an air conditioner for vehicle use comprising: a primary heat exchanger (18A) for heating while hot water supplied from a hot water source mounted on a vehicle is being used as a heat source, and an auxiliary heat exchanger (18B) for heating, which is arranged on the downstream side of the air flow of the primary heat exchanger (18A) for heating, for heating air which has passed through the primary heat exchanger (18A) for heating, wherein the auxiliary heat exchanger (18B) for heating is composed of a heat exchanger for heating according to the tenth aspect, and the electric heat generating film (40) is energized when the temperature of the hot water is not more than a predetermined temperature.

Due to the foregoing, it is possible to exhibit the operational effect of the tenth embodiment as the auxiliary heat exchanger (18B) in the air conditioner for vehicle use.

Incidentally, the reference numerals in parentheses, to denote the above means, are intended to show the relationship of the specific means which will be described later in an embodiment of the invention.

The present invention may be more fully understood from the description of preferred embodiments of the invention set forth below, together with the accompanying drawings.

DESCRIPTION OF PREFERRED EMBODIMENTS

Figure 1:
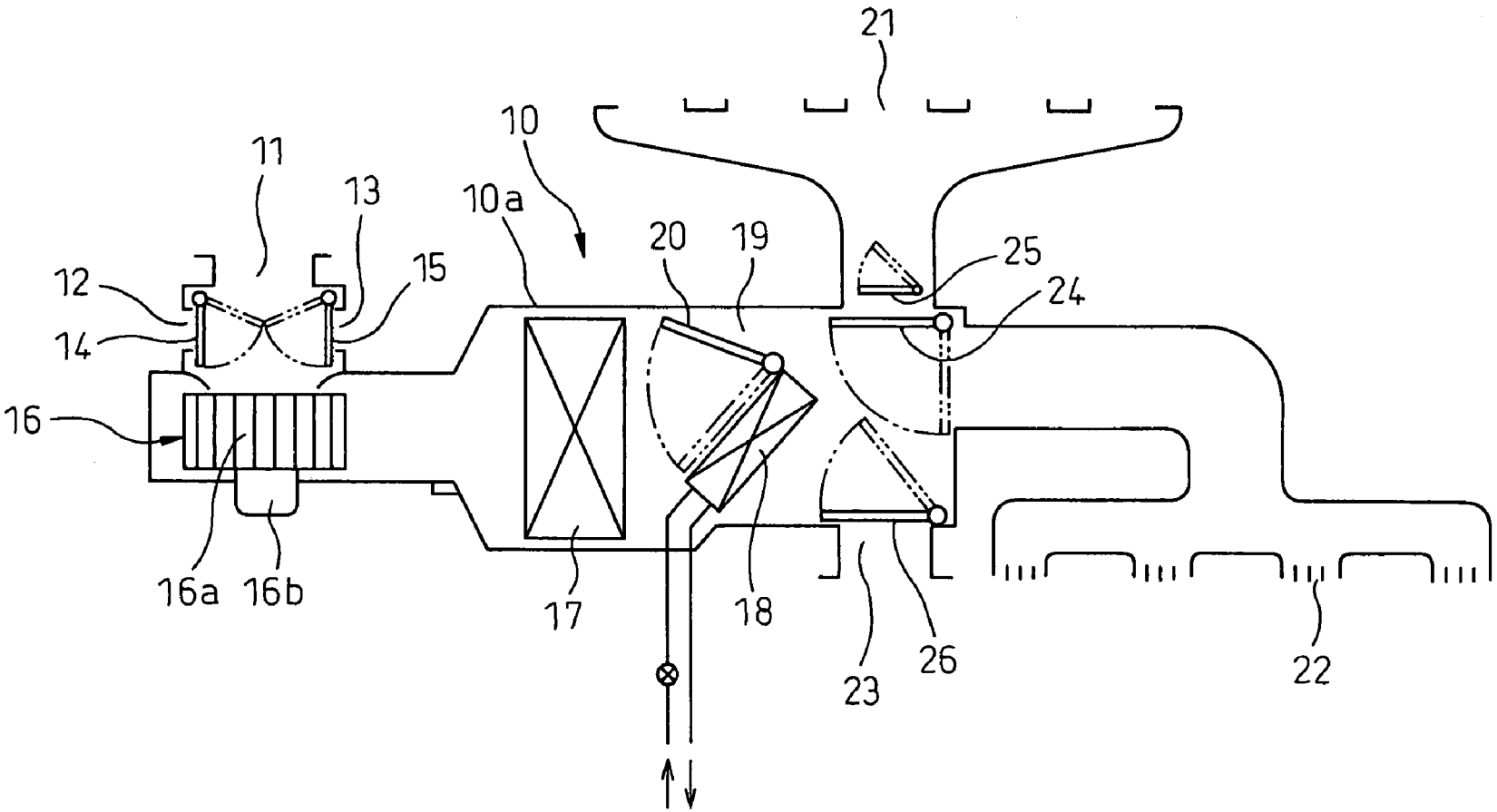
FIG. 1 is a sectional view showing an outline of the interior air conditioning unit of the air conditioner for vehicle use to which the first embodiment of the present invention is applied.

First of all, the first embodiment will be explained below. FIG. 1 is a view showing an outline of the interior air conditioning unit 10 of the air conditioner for vehicle use to which the heat exchanger for heating of the first embodiment is applied. This interior air conditioning unit 10 is usually mounted inside the instrument panel (not shown) located in the front portion of the vehicle. In the most upstream portion of the air flow of this interior air conditioning unit 10, the outside air introducing port 11 and the inside air introducing port 12 are arranged and, further, the inside and outside air changeover doors 14, 15 for opening and closing both introducing ports 11, 12, 13 are arranged.

Air (outside air or inside air) introduced from both introducing ports 11, 12, 13 is sent toward the passenger compartment through the air conditioning case 10*a* of the interior air conditioning unit 10 by the fan 16. This fan 16 is composed in such a manner that the centrifugal fan 16*a* is driven by the motor 16*b*.

Inside the air conditioning case 10*a*, the heat exchanger 17 for cooling is arranged on the downstream side of the fan 16. This heat exchanger 17 for cooling is, composed of an evaporator incorporated into the well known refrigerating cycle. The heat exchanger 18 for heating is arranged on the downstream side of the heat exchanger 17 for cooling. This heat exchanger 18 for heating is a hot water type heat exchanger (heater core) for heating air, which has passed through the heat exchanger 17 for cooling, while hot water (engine coolant) sent from the vehicle engine (not shown) is being used as a heat source. Further, in order to provide an immediate heating effect, the electric heater is integrated with the heat exchanger 18 for heating. The specific structure of this heat exchanger 18 for heating will be described later referring to FIGS. 2 to 5.

On the side of the heat exchanger 18 for heating inside the air conditioning case 10*a*, the cold air passage 19 is formed in which air (cold air), which has passed through the heat exchanger 17 for cooling, flows bypassing the heat exchanger 18 for heating. Between the heat exchanger 17 for cooling and the heat exchanger 18 for heating, the air mixing door 20 composed of a plate door capable of rotating is arranged. This air mixing door 20 adjusts a rate of the volume of a hot air passing through the heat exchanger 18 for heating to the volume of a cold air passing through the cold air passage 19, so that the temperature of air blowing out into the passenger compartment can be adjusted.

Conditioned air, the temperature of which has been adjusted by the air mixing door 20, is blown out from one of the defroster blowout port 21, the face blowout port 22 and the foot blowout port 23 into the passenger compartment. Alternatively, conditioned air is blown out from a plurality of the defroster blowout port 21, the face blowout port 22 and the foot blowout port 23 into the passenger compartment. In this case, concerning the defroster blowout port 21, conditioned air is blown out from the defroster blowout port 21 to the windshield side. Concerning the face blowout port 22, conditioned air is blown out from the face blowout port 22 to the upper half of the body of the passenger. Concerning the foot blowout port 23, conditioner air is blown out from the foot blowout port 23 to the feet of the passenger. These blowout ports 21, 22, 23 are opened and closed by the blowout mode doors 24 to 26 composed of a plate door capable of rotating.

Figure 2:
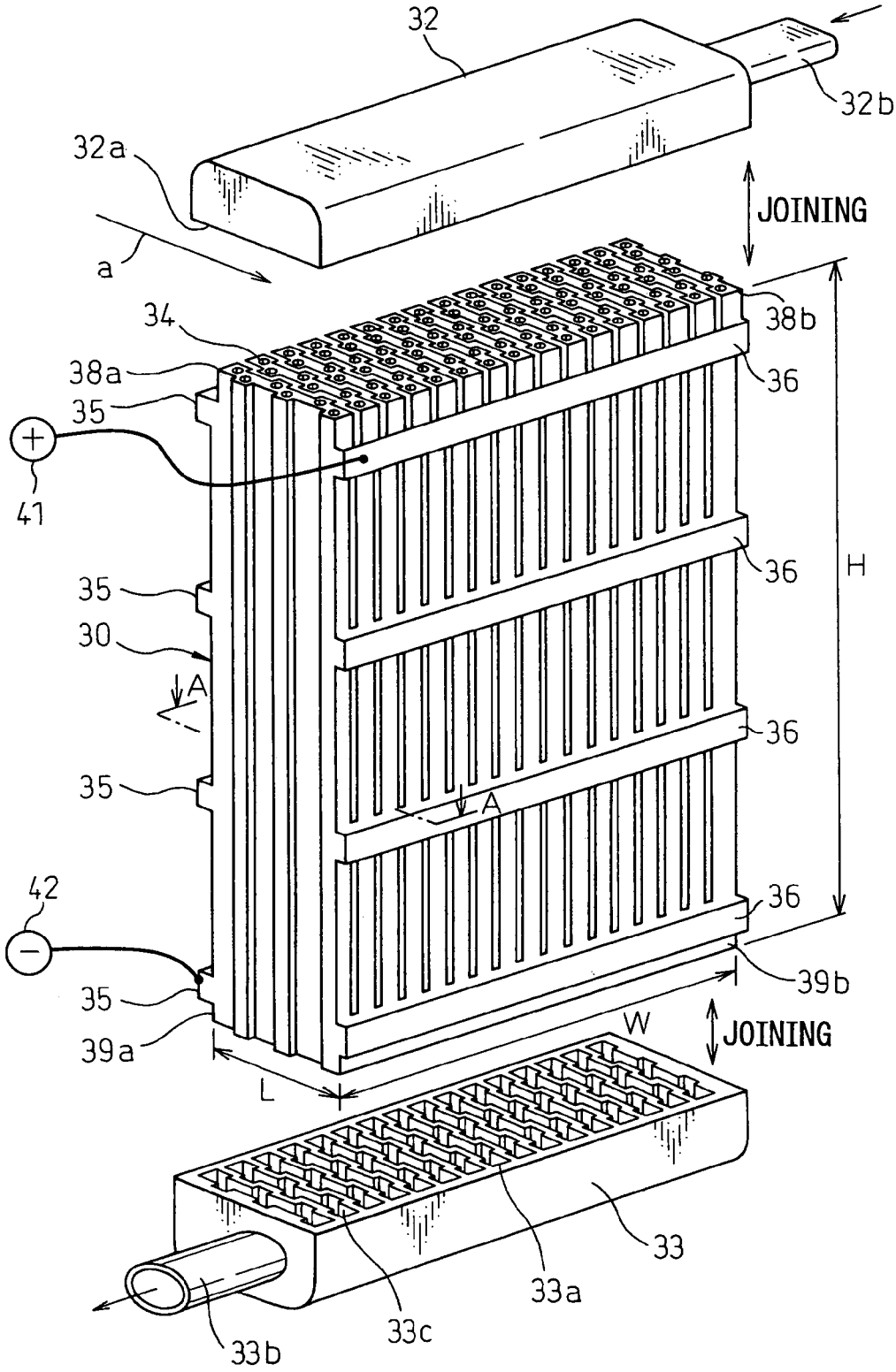
FIG. 2 is an exploded perspective view of the heat exchanger for heating of the first embodiment.
Figure 3:
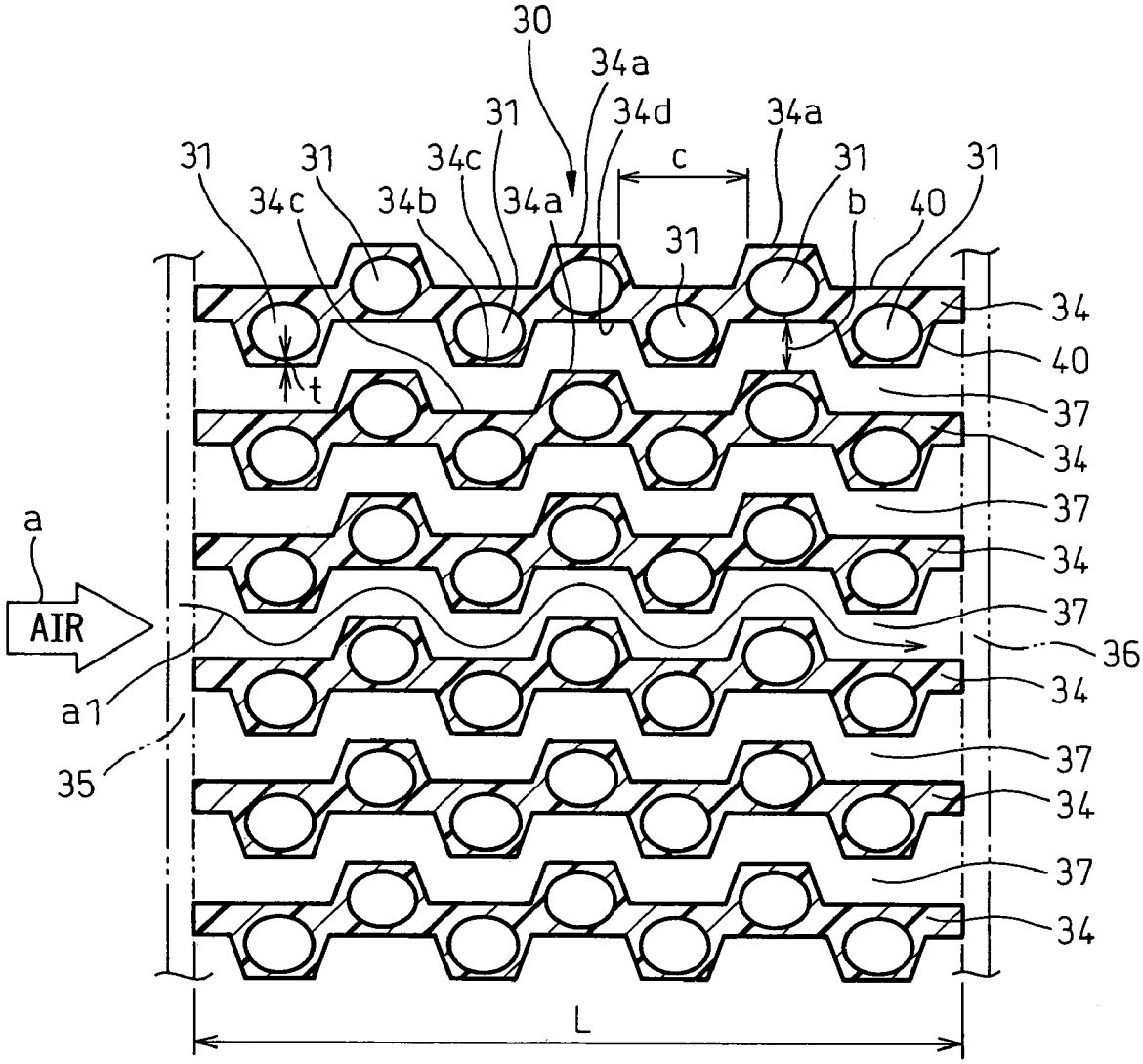
FIG. 3 is a sectional view taken on line A—A in FIG. 2.
Figure 4:
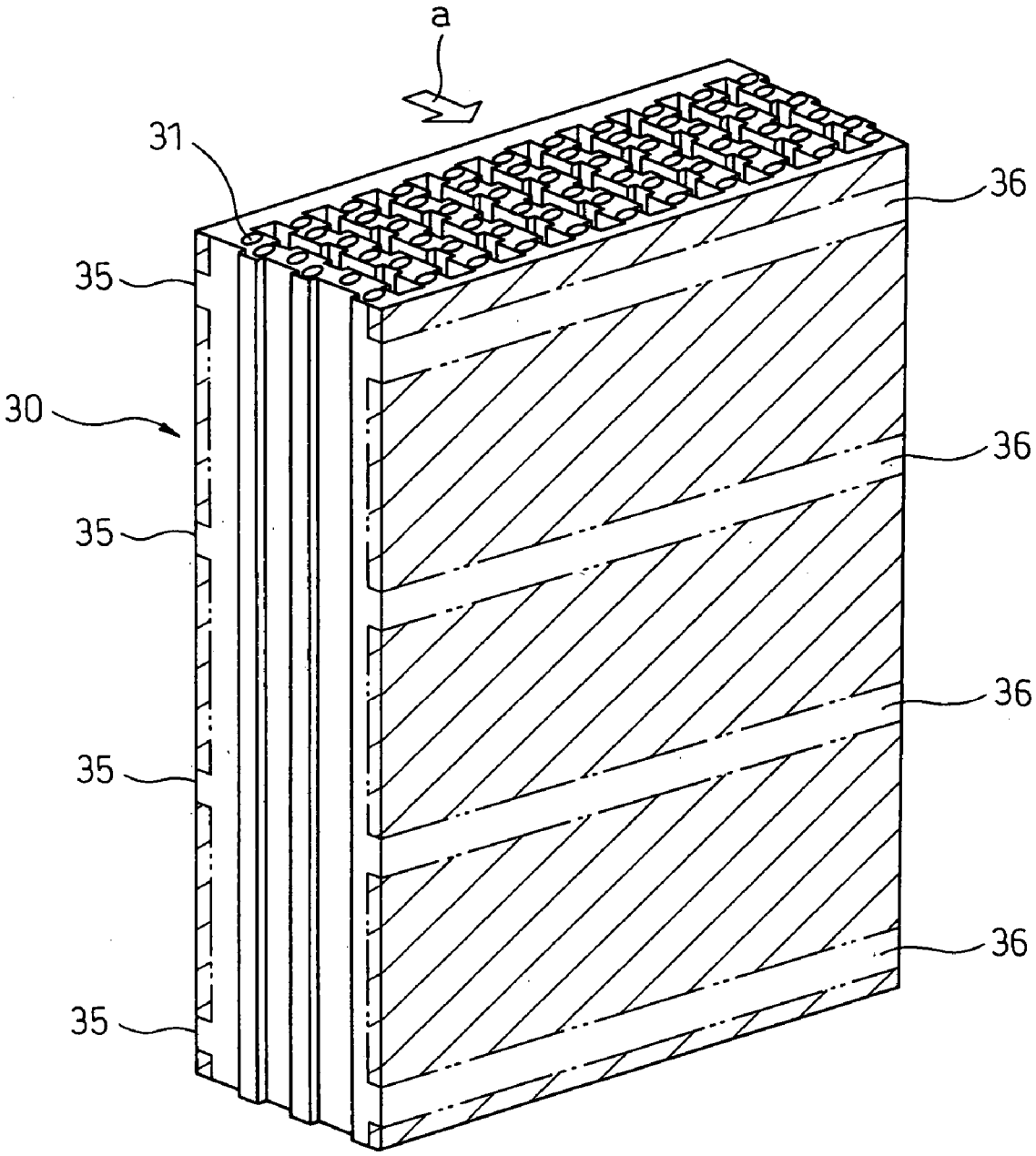
FIG. 4 is a perspective view showing a shape of the heat exchanger core portion of the heat exchanger for heating of the first embodiment immediately after the heat exchanger core portion has been formed and also showing a cutout portion of the heat exchanger core portion.
Figure 5:
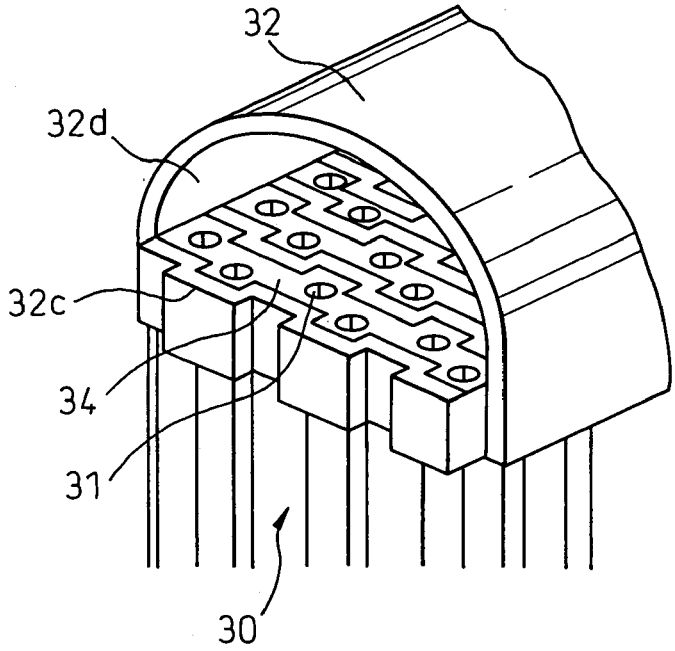
FIG. 5 is a partially cutout perspective view showing an engaging, fixing portion of the end portion of the heat exchange core portion and the tank portion in the first embodiment.

Next, referring to FIGS. 2 to 5, the specific structure of the heat exchanger 18 for heating will be described in detail. FIG. 2 is an exploded perspective view of the heat exchanger 18 for heating of this embodiment. FIG. 3 is a sectional view taken on line A—A in FIG. 2. FIG. 4 is a perspective view showing a shape of the heat exchanger core portion 30 for conducting heat exchange between air and fluid, wherein this view shows the shape of the heat exchanger core portion 30 immediately after the completion of extrusion molding of the heat exchanger core portion 30. FIG. 5 is a partially cutout perspective view showing an engaging, fixing portion of the upper end portion of the heat exchange core portion 30 and the upper tank portion 32.

The heat exchanger 18 for heating includes: a heat exchange core portion 30; and an upper 32 and a lower tank portion 33 which are joined to both end portions of the inner fluid passage 31 formed in the heat exchange core portion 30, that is, joined to both the upper end portion and the lower end portion in FIG. 2.

In the heat exchange core portion 30, a large number of heat transfer plate members 34 are arranged in parallel to each other in the air flow direction. This large number of heat transfer plate members 34 are integrally connected to each other by the connecting portions 35, 36. In this case, the heat transfer plate members 34 and the connecting portions 35, 36 can be formed of resin, which is an electrically insulating material, by means of integral molding. Concerning the resin material, it is preferable to use resin, the heat resisting property of which is high and, for example, it is preferable to use polyamide resin. In this connection, the upper limit of the hot water temperature is approximately 110° C. to 120° C., and the upper limit of heat generation of the electric heat generating film described later is, for example, approximately 80° C. to 100° C. Therefore, it is necessary to select a resin material, the heat resistant temperature of which is higher than these upper limit temperatures.

The entire shape of the large number of heat transfer plates 34 is formed into a rectangular plate shape, in which the entire shape extends in the air flow direction "a" by a predetermined length L and also extends in the direction perpendicular to the air flow direction "a" (the vertical direction in FIG. 2) by a predetermined height H, and the large number of heat transfer plates 34 are laminated in the width direction (the lateral direction in FIG. 2) of the heat exchange core portion 30 being separate from each other by a predetermined interval "b". Due to this predetermined interval "b", the air passages 37, in which the outer fluid flows, are formed between the adjoining heat transfer plate members 34.

On both sides of each heat transfer plate member 34, the hollow protruding portions 34*a*, 34*b*, which protrude in the laminating direction of the heat transfer plate members, that is, which protrude onto the air passage side 37, are integrally formed. These protruding portions 34*a*, 34*b* are substantially trapezoidal. These substantially trapezoidal protruding portions 34*a*, 34*b* are formed all over the height H of the heat transfer plate members 34.

Inside of each protruding portion 34*a*, 34*b*, the hollow inner fluid passage 31, the cross-section of which is circular, is formed. Hot water (engine coolant), which is a fluid for heating, circulates in this inner fluid passage 31. Therefore, the upper and the lower end portions of the inner fluid passages 31 are open and communicated with the inner spaces of the upper 32 and the lower tank 33.

The protruding portions 34*a* and 34*b* are alternately formed at predetermined intervals "c", (shown in FIG. 3) in the air flow direction "a", and the recess portions 34*c*, 34*d* are formed in portions at predetermined intervals "c". Between the heat transfer plate members 34, which are adjacent to each other, the protruding portion 34*a* is opposed to the recess portion 34*d*, and the protruding portion 34*b* is opposed to the recess portion 34*c*. Due to the above constitution, the air passage 37 is formed into a meandering shape as shown by arrow "a1". In this connection, a predetermined interval "b" is an interval between the protruding portion 34*a* and the recess portion 34*d* which are opposed to each other. Alternatively, a predetermined interval "b" is an interval between the protruding portion 34*b* and the recess portion 34*c* which are opposed to each other.

The connecting portions 35, 36 are long, slender plate members extending in the width direction (the lateral direction in FIG. 2) of the heat exchange core portion 30, the connecting portions 35, 36 being arranged in both end portions at the front and rear of the large number of heat transfer plate members 34 in the air flow direction "a". The connecting portions 35, 36 connect the large number of heat transfer plates 34 into one body. As shown in FIG. 2, the four connecting portions 35 and the four connecting portions 36 are respectively arranged in parallel to each other at predetermined intervals.

As shown in FIGS. 2 and 5, in the upper and the lower end portion of the heat exchange core portion 30, the engaging fixing portions 38*a*, 38*b*, 39*a*, 39*b* are formed which are engaged and fixed to the inside of the upper 32 and the lower tank portion 33. In these engaging fixing portions 38*a*, 38*b*, 39*a*, 39*b*, the connecting portions 35, 36 are not provided. Therefore, these engaging fixing portions 38*a*, 38*b*, 39*a*, 39*b* are smaller than the portions, in which the connecting portions 35, 36 are formed, by the size of the protrusion of the connecting portion 35, 36.

In this case, in the same manner as that of the heat exchange core portion 30, the upper 32 and the lower tank portion 33 are made of polyamide resin, the heat resistant property of which is excellent. The upper 32 and the lower tank portion 33 are respectively formed into a semicircular hollow shape. Reference numerals 32*a*, 33*a* are end faces of the openings of the semicircular hollow shape. The upper tank portion 32 is a hot water tank on the entrance side and is formed integrally with the hot water entrance pipe 32*b* for introducing hot water. The lower tank portion 33 is a hot water tank on the delivery side and is formed integrally with the hot water delivery pipe 33*b* for discharging hot water.

Further, as shown in FIG. 2, inside the lower tank portion 33, a large number of slit engaging shape portions 33*c*, by which the lower end portions (portions corresponding to the forming portions of the lower side engaging fixing portions 39*a*, 39*b*) of the heat transfer plate portions 34 are engaged and supported, are integrally formed. Further, as shown in FIG. 5, inside the upper tank portion 32, a large number of slit engaging portions 32*c*, by which the upper end portions (portions corresponding to the forming portions of the upper side engaging fixing portions 38*a*, 38*b*) of the heat transfer plate portions 34 are engaged and supported, are integrally formed.

As shown in FIG. 5, the upper end opening portions of the inner fluid passages 31 of the heat transfer plate members 34 are communicated with the hot water entrance pipe 32*b* via the inner space 32*d* (shown in FIG. 5) of the upper tank portion 32. In the same manner, the lower end opening portions of the inner fluid passages 31 of the heat transfer plate members 34 are communicated with the hot water discharge pipe 33*b* via the inner space (not shown in the drawing) of the lower tank portion 33.

The engaging fixing portions 38*a*, 38*b*, 39*a*, 39*b* of the upper and the lower end portion of the heat exchange core portion 30 are inserted into the inner space of the tank from the opening end portions 32*a*, 33*a* of the upper 32 and the lower tank portion 33, and the upper and the lower end portions of the heat transfer plate members 34 and the slit engaging shape portions 33*c* are engaged with each other via adhesive. Due to the foregoing, the upper and the lower end portion of the heat exchange core portion 30 are bonded and fixed to the upper 32 and the lower tank portion 33. In this case, the joining portion between the upper and the lower end portion of the heat exchange core portion 30 and the upper 32 and the lower tank portion 33 is coated and sealed with adhesive, so that hot water can be prevented from leaking out.

On the other hand, the electric heat generating film 40 (shown in FIG. 3), the shape of which is formed into a thin film, is integrally provided on the entire outer surface region of the heat exchange core portion 30, that is, on the entire outer surface regions of the heat transfer plate member 34 and the connecting portions 35, 36. In FIG. 3, bold lines are attached to the entire outer surface region of the heat transfer plate member, so that the forming range of the electric heat generating film 40 can be shown by these bold lines.

In this embodiment, the electric heat generating film 40 is continuously formed on the outer surfaces of the heat transfer plate member 34 and the connecting portions 35, 36. Therefore, the electric heat generating film 40 on a large number of heat transfer plate members 34 is electrically connected to the electric heat generating films 40 on the connecting portions 35, 36.

The positive side terminal 41 for supplying electric power is electrically connected to the connecting portion 36, which is one of the plurality of connecting portions 35, 36, located in the upper end portion on the downstream side of an air flow, and the negative side terminal 42 for supplying electric power is electrically connected to the connecting portion 35, which is one of the plurality of connecting portions 35, 36, located in the lower end portion on the upstream side of an air flow. As described above, in this embodiment, the connecting positions of the terminals 41, 42 on the positive and the negative electrode side for supplying electric power are set at positions on the diagonal line of the heat exchange core portion 30, so that the electric heat generating film 40 in all regions on the outer surface of the heat exchange core portion 30 can be energized as uniformly as possible.

Next, referring to FIG. 6, an outline of the electric control portion for controlling to energize the electric heat generating film 40 in this embodiment will be explained below. An electric current supplied to the electric heat generating film 40 is controlled by an output signal sent from the air conditioning control unit 43. This air conditioning control unit 43 is composed of a microcomputer and its peripheral circuit. In this air conditioning control unit 43, a predetermined calculation is conducted by the program which has been previously set in the microcomputer so as to control operation of the air conditioning devices. In this case, the air conditioning devices includes the electric heat generating film 40, the motor 16*b* for driving the fan 16, the motor 14*a* for driving the inside and outside air changeover doors 14, 15, the motor 20*a* for driving the air mixing door 20, and the motor 24*a* for driving the blowout mode doors 24, 25, 26.

A sensor detection signal is inputted from the sensor group 44 into the air conditioning control unit 43. This sensor group 44 includes the heat generating body temperature sensors 44*a*, which are arranged coming into contact with the surface of the electric heat generating film 40, for directly detecting the surface temperature of the electric heat generating film 40. In addition to the heat generating body temperature sensors 44*a*, the sensor group 44 includes well known sensors for detecting inside air temperature $T_r$, outside air temperature $T_{am}$, the amount of sunshine $T_s$, hot water temperature $T_w$, and blowout temperature $T_e$ of the evaporator 3.

Operation signals of the operation switch group 46 on the air conditioning control panel 45, which is arranged close to the instrument panel in the passenger compartment, are also inputted into the air conditioning control unit 43. Specifically, this operation switch group 46 includes: a temperature setting switch for generating temperature setting signal $T_{set}$ in the passenger compartment, an air amount switch for generating an air amount changeover signal of the fan 16, a blowing mode switch for generating a blowing mode changeover signal for the blowing mode doors 25, 26, an inside and outside air changeover switch for generating an inside and outside air changeover signal for the inside and outside air changeover doors 14, 15, an air conditioner switch for generating an ON-OFF signal of the air conditioning compressor, and a switch for setting an automatic state of air conditioning control.

Next, explanations will be made into the method of manufacturing a heat exchanger for heating. First, the heat exchanger core portion 30 is formed into a rectangular parallelepiped shown in FIG. 4 by means of extrusion of a resin material. FIG. 4 is a view showing a shape of the rectangular parallelepiped immediately after the completion of this extrusion. A cross-sectional shape of the heat transfer plate member 34 is formed as shown in FIG. 3. According to the shape of this rectangular parallelepiped, both the end face on the upstream side of the air flow direction "a" and the end face on the downstream side are closed. Therefore, it is necessary to open both the end faces.

Hatched portions on the upstream side end face and the downstream side end face of this rectangular parallelepiped shown in FIG. 4 are cut away after the completion of extrusion, that is, portions excepting the portions, in which the connecting portions 35, 36 are formed, are cut away after the completion of extrusion. Due to the foregoing, the upstream side end and the downstream side end of the air passage 37 can be opened. Even after the hatched portions shown in FIG. 4 have been cut away, a large number of heat transfer plate members 34 are integrally connected to each other by the connecting portions 35, 36.

Next, the upper and the lower end portion of the heat exchange core portion 30 are joined to the upper 32 and the lower tank portion 33. Specifically, the joining operation is conducted as follows. Adhesive is coated in the outer peripheral portions of the engaging fixing portions 38*a*, 38*b*, 39*a*, 39*b* of the upper and the lower end portion of the heat exchange core portion 30. After that, the engaging fixing portions 38*a*, 38*b*, 39*a*, 39*b* are inserted into the upper 32 and the lower tank portion 33. The upper and the lower end portion of the heat transfer plate members 34, and the slit engaging portions 33*c* of the upper 32 and the lower tank portion 33 are engaged with each other via adhesive, so that the upper and the lower end portion of the heat exchange core portion 30 can be bonded and fixed to the inner face of the upper 32 and the lower tank portion 33. In this way, the heat exchange core portion 30 of the heat exchanger 18 for heating is incorporated into the tank portions 32, 33.

Next, a process is executed in which the electric heat generating film 40 is formed on the outer surface of the heat exchange core portion 30. In the present embodiment, a dipping processing method is used for this film forming method. Specifically, operation is conducted as follows. A film processing solution is made in such a manner that conductive powder (for example, nickel powder) and resin powder (for example, acrylic resin powder) are mixed with each other and then the viscosity is adjusted by adding a solvent. Thus made film processing solution is stored in a processing solution tank.

The entire structure (30, 32, 33) of the heat exchanger 18 for heating is dipped for a predetermined period of time in this processing solution, and the processing solution is attached to all the outer surface of the heat exchanger 18 for heating. In this case, it is unnecessary to make the film processing solution flow from the hot water inlet pipe 32*b* and outlet pipe 33*b* into the tank portions 32, 33. Therefore, both pipes 32*b*, 33*b* are closed by lid members, and then the heat exchanger 18 for heating is dipped in the film processing solution.

After that, the heat exchanger 18 for heating is taken out from the processing solution tank and dried. Specifically, when the heat exchanger 18 for heating is heated at a predetermined heating temperature (for example, 80° C.) for a predetermined period of time (for example, 15 minutes) so as to evaporate the solvent, the conductive resin film, into which conductive powder is mixed, that is, the electric heat generating film 40 is formed on the outer surface of the heat exchanger 18 for heating. By the function of the aforementioned acrylic resin, a thin film of the conductive powder can be held on the heat transfer plate members 34.

According to the above method, while the electric heat generating film 40 is formed on the outer surface of the heat exchange core portion 30 (the heat transfer plate members 34 and the connecting portions 35, 36), the electric heat generating film 40 is also formed on the outer surfaces of the tank portions 32, 33 in which the forming of the electric heat generating film 40 is not required. However, as the areas of the outer surfaces of the tank portions 32, 33 are much smaller than the area of the outer surface of the heat exchange core portion 30, the amount of the film processing solution, which is attached onto the outer surfaces of the tank portions 32, 33, is relatively small. Therefore, even if the electric heat generating film 40 is formed on the outer surfaces of the tank portions 32, 33, no problems are caused in the practical use.

Naturally, when the heat exchanger 18 for heating is dipped in the film processing solution while the outer surfaces of the tank portions 32, 33 are covered with an appropriate cover member, it is possible to prevent the electric heat generating film 40 from being formed on the outer surfaces of the tank portions 32, 33. When the heat exchange core portion 30 is dipped in the film processing solution and dried under the condition that both opening portions of the inner fluid passage 31 are closed with lid members before the heat exchange core portion 30 and the tank portions 32, 33 are integrally incorporated with each other, the electric heat generating film 40 can be formed only on the outer surface of the heat exchange core portion 30.

After the electric heat generating film 40 has been formed, the positive electrode side terminal 41 and the negative electrode side terminal 42 are electrically connected to predetermined portions of the electric heat generating film 40. In this way, manufacturing of the heat exchanger 18 for heating is completed.

The value of electric resistance of the electric heat generating film 40 is determined by the size of the heat exchange core portion 30 and the target heat generating output. For example, in the case where width W of the heat exchange core portion 30 is W=200 mm, height H of the heat exchange core portion 30 is H=180 mm, length L of the heat exchange core portion 30 is L=27 mm, and when the target heat generating output=1 KW, the target value of electric resistance per unit area is approximately 20 Ω/sq. In this case, the thickness of the film 40 is approximately 50 $\mu$m.

Next, the operation of the heat exchanger 18 for heating of the present embodiment will be explained as follows. In winter, when the heating is needed immediately after the vehicle engine has been started, the temperature of the engine coolant is as low as the atmospheric temperature, that is, the temperature of the engine coolant is very low. Therefore, it is impossible for the heat exchanger 18 for heating to utilize the engine coolant as a heat source to heat air to be blown out into the passenger compartment.

Therefore, in this embodiment, the air conditioning control unit 43 judges that the temperature of the engine coolant is low, in winter, and an electric circuit between the electric heat generating film 40 and the battery (not shown) mounted on the vehicle is automatically turned on, so that the electric heat generating film 40 can be energized. In this connection, the air conditioning control unit 43 judges that hot water temperature $T_w$ detected by the water temperature sensor in the sensor group 44 is lower than a predetermined temperature and the passenger compartment is in an environment in which the heating is needed, and the electric heat generating film 40 is automatically energized.

When the latter environmental conditions, in which the heating is needed, is judged, it may be judged that that passenger compartment temperature $T_r$ detected by the inside air sensor is not more than a predetermined temperature. Except for that, it may be judged that the atmospheric temperature $T_{am}$ detected by the atmospheric temperature sensor in the sensor group 44 is not more than a predetermined temperature. Further, it may be judged that target blowout temperature (target temperature of the blowout air into the passenger compartment) TAO calculated according to the air conditioning heat load in the air conditioning control unit 43 is not less than a predetermined temperature.

When the electric heat generating film 40 is energized, the electric heat generating film 40 is heated, and it becomes possible to heat air by the electric heat generating film 40. When the thus heated air is blown out from the foot blowout port 23 and so forth into the passenger compartment, the immediate heating effect can be provided in the passenger compartment even when the temperature of the engine coolant is low.

The immediately effective heating is more specifically explained as follows. While the electric heat generating film 40 is being energized, the motor 16*b* for driving the fan 16 is energized by an output signal sent from the air conditioning control unit 43 so that the fan 16 can be driven. Then, air blown by the fan 16 passes through the heat exchanger 17 for cooling. After that, the air passes through a large number of air passages 37 of the heat exchange core portion 30 of the heat exchanger 18 for heating.

At this time, heat generated on the electric heat generating film 40 can be effectively transmitted to the air passing in the air passages 37. The reason is as follows. First, since the heat generating plate member 34 is made of a resin material, the heat conductivity of which is much lower than that of metallic material, heat generated by the electric heat generating film 40 is effectively prevented from being absorbed by the coolant at low temperature flowing in the inner fluid passages 31 via the heat transfer plate members 34.

Secondarily, as the electric heat generating film 40 is formed on all the outer surfaces (the protruded and recessed surfaces) of a large number of heat transfer plate members 34 composing a large number of air passages 37, an area in which the electric heat generating film 40 is formed can be extended.

Thirdly, even when the heat exchange core portion 30 is of the finless structure in which no fins are provided, the heat transfer coefficient on the air side on the surface of the electric heat generating film 40 can be greatly enhanced. The reasons are described below. The protruding portions 34*a*, 34*b* on the heat transfer plate member 34 obstruct that a current of air in the air passage 37 flows forward. Therefore, the current of air shown by arrow al in FIG. 3 flows while it is colliding with the protruding portions 34*a*, 34*b* in the air passage 37. This meandering flow of air generates a disturbance in the flow. Due to the foregoing, a turbulent flow of air is generated on the surface of the electric heat generating film 40. Therefore, the heat transfer coefficient on air side on the surface of the electric heat generating film 40 can be greatly enhanced.

For the first to the third reasons described above, heat generated on the electric heat generating film 40 can be effectively transmitted to the air passing in the air passage 37. Therefore, the passenger compartment can be immediately heated by the heat generated on the electric heat generating film 40 while limited electric power, which is generated by the battery mounted on the vehicle, is being effectively utilized.

Figure 6:
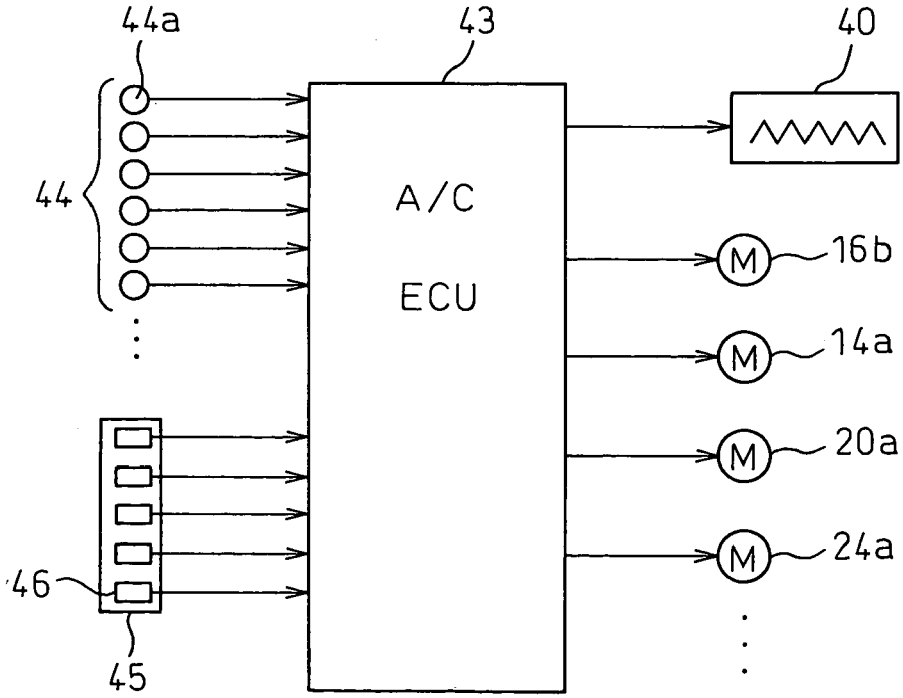
FIG. 6 is an electric control block diagram of the first embodiment.

When the electric heat generating film 40 is energized, surface temperature $_{Th}$ of the electric heat generating film 40 is detected by the heat generating body temperature sensor 44*a* (shown in FIG. 6). At the same time, the air conditioning control unit 43 judges whether or not this surface temperature $T_h$ of the electric heat generating film 40 has increased to a predetermined upper limit temperature (allowable temperature), for example, whether or not this surface temperature $T_h$ has been raised to 80° C. to 100° C. Therefore, when this surface temperature $T_h$ has been raised to a predetermined upper limit temperature, an electric current flowing to the electric heat generating film 40 can be automatically shut off by an output signal sent from the air conditioning control unit 43. Due to the foregoing, it is possible to prevent surface temperature $T_h$ from being raised to a temperature not lower than the upper limit temperature, that is, it is possible to prevent the occurrence of an overheat state of the electric heat generating film 40. Therefore, the safety of the heat exchanger 18 for heating can be enhanced.

When a predetermined period of time has passed after the vehicle engine started, warm-up of the vehicle engine proceeds and the coolant temperature is raised. When the temperature of hot water is increased higher than a predetermined temperature (for example, about 50° C.), it becomes possible to heat the passenger compartment by air heated by the heat source of hot water. When the air conditioning control unit 43 judges that the hot water temperature has increased higher than the predetermined temperature, an electric current supplied to the electric heat generating film 40 is shut off by an output signal sent from the air conditioning control unit 43, so that the electric heat generating film 40 stops generating heat. Accordingly, after that, hot water, which circulates in the route of the hot water inlet pipe 32*b*→the upper tank 32 on the hot water inlet side→the inner fluid passage 31 of the heat exchange core portion 30→the lower tank 33 on the hot water outlet side→the hot water outlet pipe 33*b*, is used as a heat source and air is heated so as to heat the passenger compartment.

As the heat transfer plate members 34 of the hear exchange core portion 30 are made of a resin material, the heat conductivity of which is much lower than that of metallic material, in the case of normal heating in which the hot water is used as a heat source, there is a possibility that the heating performance is deteriorated. Therefore, the present inventors made investigation into the prevention of the heating performance in the normal heating in which hot water is used as a heat source.

Figure 7:
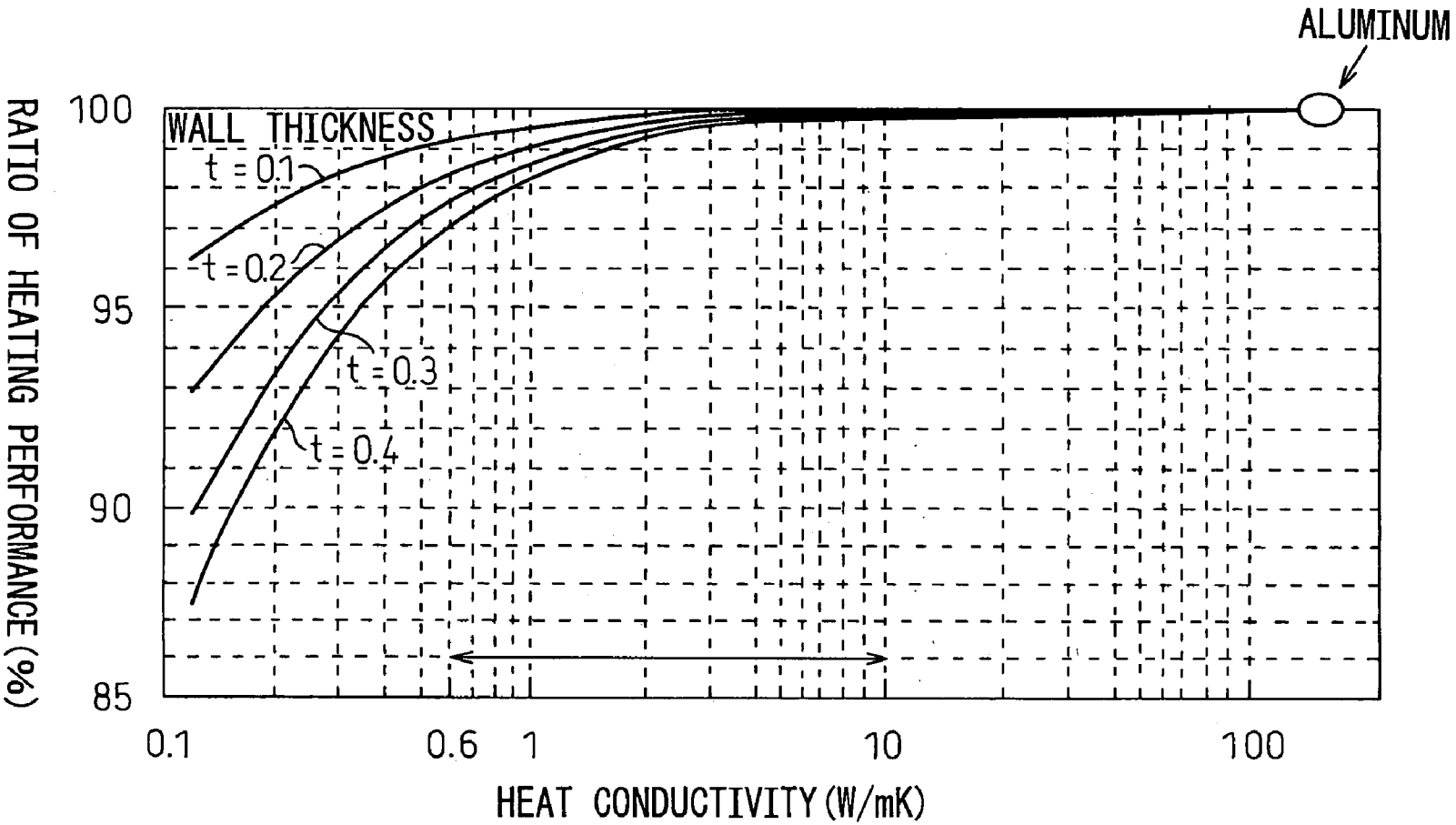
FIG. 7 is a graph showing a relation between the heat conductivity and the wall thickness of a heat transfer plate member and the heating performance.

FIG. 7 is a graph showing a ratio of heating performance in the case of normal heating in which hot water is used as a heat source. The abscissa represents a heat conductivity of material composing the heat transfer plate member 34. The ordinate represents a ratio (%) of the heating performance (the amount of radiated heat) in the case where the heat conductivity and the wall thickness of the heat transfer plate member 34 are changed, to the heating performance (the amount of radiated heat) in the case where the heat transfer plate member 34 is made of aluminum, which is a typical material of the heat exchanger for vehicle use, wherein this heating performance, in which the heat transfer plate member 34 is made of aluminum, is set at 100%. In this connection, as shown in FIG. 3, the wall thickness t of the heat transfer plate member 34 is the wall thickness of the minimum wall thickness portion in the periphery of the inner fluid passage 31 of the heat transfer plate 34.

FIG. 7 is a graph showing a degree of the influence which is given to the heating performance by the wall thickness t of the heat transfer plate member 34 and the heat conductivity of the heat transfer plate member 34. As shown in FIG. 7, it can be understood that the larger the thickness t is, the lower the heating performance is deteriorated.

The following can be understood from the graph shown in FIG. 7. Even if the wall thickness t is the maximum value 0.4 mm in FIG. 7, when a resin material, the heat conductivity of which is not less than 0.6 W/mK, is selected, it is possible to exhibit a high heating performance which is 97% of the heating performance of the heat exchanger made of aluminum. This deterioration of 3% of the heating performance with respect to the heating performance 100% of the heat exchanger made of aluminum is so small that no passenger feels a difference in heating when the heat exchanger for heating is put into practical use. Accordingly, when the wall thickness t is not more than 0.4 mm and the heat conductivity is not less than 0.6 W/mK, even if the heat transfer plate member 34 of the heat exchange core portion 30 is made of a resin material, it is possible to provide a heat exchanger, the heating performance of which is sufficiently high. In this connection, as the heat conductivity of polyamide resin, which is a specific example of the material used for the heat transfer plate member 34, is not less than 0.7 W/mK, the above condition that the heat conductivity is not less than 0.6 W/mK can be satisfied.

In this connection, in order to enhance the heating performance, it is preferable that the wall thickness t is small. However, in order to ensure the pressure withstanding strength with respect to the pressure of hot water, it is preferable that the practical wall thickness t is not less than 0.1 mm.

On the other hand, it is preferable that the upper limit of the heat conductivity of the heat transfer plate member 34 is not more than 10 W/mK so that the efficiency can be enhanced in the case of immediately effective heating conducted by heat generated on the electric heat generating film 40. The reason is described below. In the case where the heat transfer plate 34 is made of aluminum, as the heat conductivity of aluminum is very high, about a half of the heat generated by the electric heat generating film 40 is transmitted to water at low temperature flowing in the inner fluid passage 31. Therefore, only a half of the heat generated by the electric heat generating film 40 is transmitted to the air which must be heated. As a result, it becomes impossible to effectively conduct the immediately effective heating by the electric heat generating film 40.

However, in this embodiment, the heat transfer plate member 34 is made of resin. Therefore, it is easy to suppress the upper limit of the heat conductivity of resin to be not more than 10 W/mK. When the upper limit of the heat conductivity of the heat transfer plate member 34 is not more than 10 W/mK, as the value is not more than 1/10 of the heat conductivity of aluminum, the amount of heat transmitted to water at low temperature flowing in the inner fluid passage 31 can be reduced to a value not more than 1/10 of the case in which aluminum is used. Accordingly, the immediately effective heating can be effectively conducted by the heat generated by the electric heat generating film 40.

Figure 8:
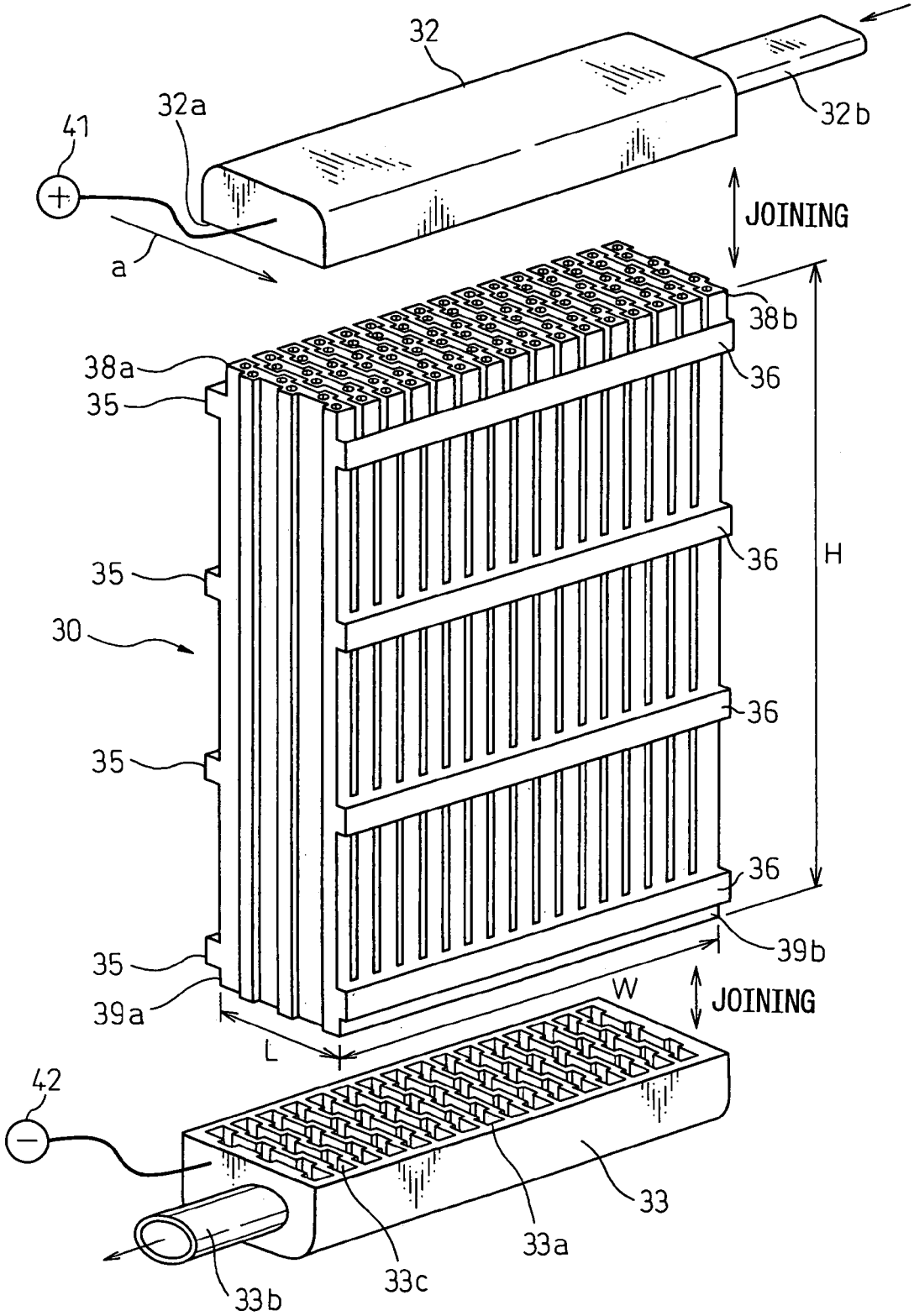
FIG. 8 is an exploded perspective view of the heat exchanger for heating of the second embodiment.

Next, the second embodiment will be explained below. FIG. 8 is a view showing the second embodiment of the present invention. In the case where the electric heat generating films 40 are also formed on the outer surfaces of the upper 32 and the lower tank portion 33 as in the first embodiment, the electric heat generating film 40 of one of the upper 32 and the lower tank portion 33, for example, the electric heat generating film 40 of the upper tank portion 32 is connected to the positive electrode side terminal portion 41, and the electric heat generating film 40 of the other of the upper 32 and the lower tank portion 33, for example, the electric heat generating film 40 of the lower tank portion 33 is connected to the negative electrode side terminal portion 42. Due to the above constitution, the electric heat generating film 40 of the heat transfer plate member 34 can be energized via the electric heat generating films 40 of both tank portions 32, 33.

As described above, the connecting portions of the terminal portions 41, 42 are not limited to the heat exchange core portion 30, but the connecting portions of the terminal portions 41, 42 can be set on the tank portions 32, 33.

Next, the third embodiment of the present invention will be explained below. In the first embodiment, the electric heat generating film 40 is formed on all the outer surface of the heat transfer plate member 34 of the heat exchange core portion 30, and the energization of voltage (supply of voltage) upon one positive electrode side terminal portion 41, which is connected to the connecting portion 36, is turned on and off so that the energization of voltage upon the entire electric heat generating film 40 can be turned on and off. Therefore, from the electrical viewpoint, this electric heat generating film 40 composes one electric heat generating body. On the other hand, in the second embodiment, the heat transfer plate member 34 of the heat exchange core portion 30 is divided into a plurality of regions, and the electric heat generating films 40 are formed in these plurality of regions so that they can be independently controlled.

Figure 9:
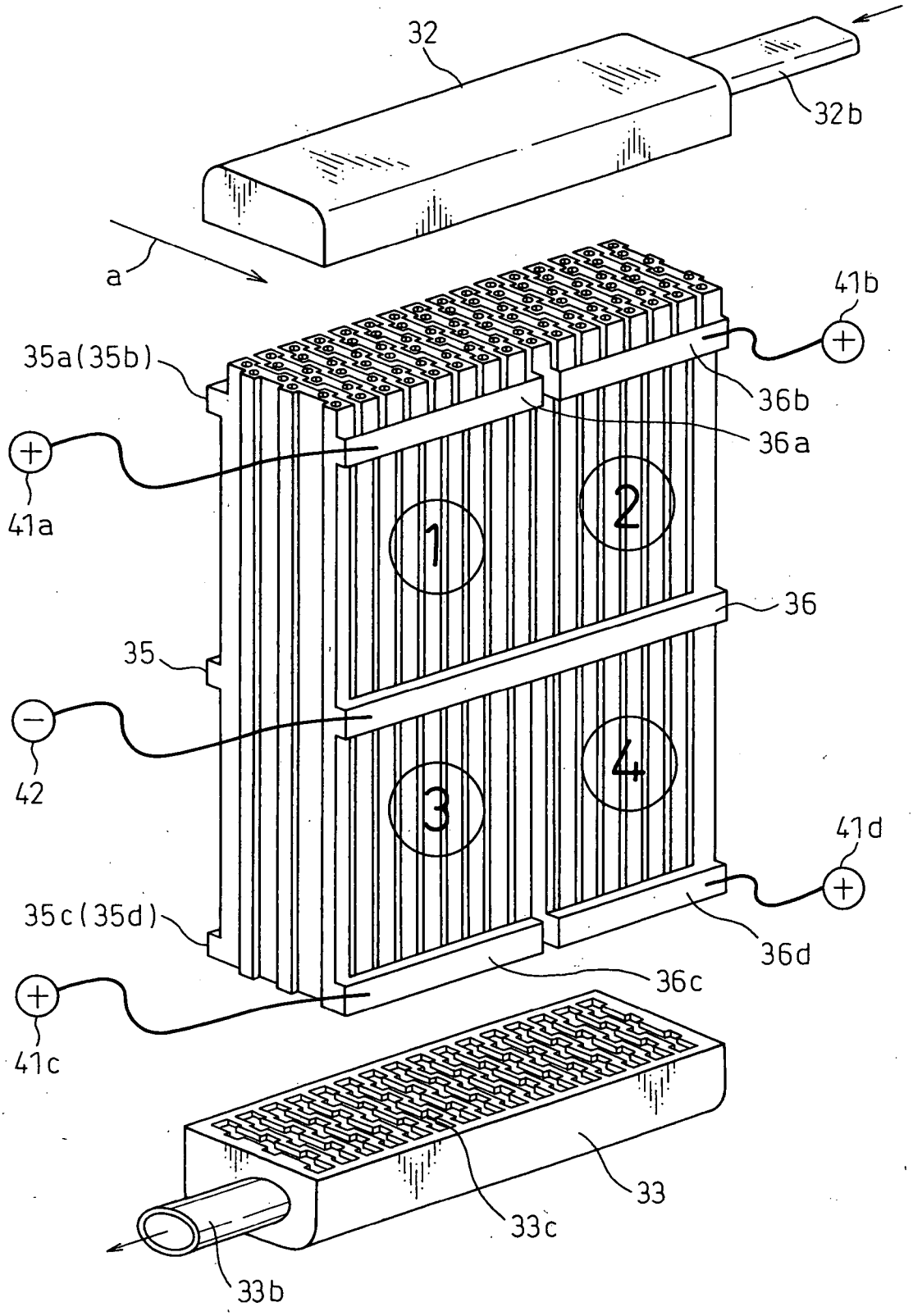
FIG. 9 is an exploded perspective view of the heat exchanger for heating of the third embodiment.

FIG. 9 is a view showing a specific example of the second embodiment. As shown in FIG. 9, the heat transfer plate member 34 of the heat exchange core portion 30 is divided into regions (1) to (4) which are respectively located on the upper side, the lower side, the right and the left. In these four regions, the electric heat generating films 40 are respectively formed so that they can be independently controlled.

More specifically, at the central portion of the heat exchange core portion 30 in the vertical direction, the connecting portions 35, 36 extending to the overall length of the heat exchange core portion 30 in the width direction (direction W) are composed. One of the connecting portions 35, 36, that is, one of the front side connecting portion 35 and the rear side connecting portion 36 with respect to the direction "a" of the air flow, for example, on the electric heat generating film 40 on the connecting portion 36 on the downstream side, the negative electrode side terminal portion 42 is connected.

On the other hand, in the neighborhoods of the upper end portion and the lower end portion of the heat exchange core portion 30, the connecting portions 36*a*, 36*b* and the connecting portions 36*c*, 36*d*, which are formed when the width of the heat exchange core portion 30 is divided into two in the lateral direction, are composed.

These connecting portions 36*a*, 36*b*, 36*c*, 36*d* are formed on the downstream side of the air flow direction "a". However, even on the upstream side of the air flow direction "a", the connecting portions 35*a*, 35*b*, which are formed when the neighborhood of the upper end portion of the heat exchange core portion 30 is divided into two in the lateral direction, and the connecting portions 35*c*, 35*d*, which are formed when the neighborhood of the lower end portion of the heat exchange core portion 30 is divided into two in the lateral direction, are composed. In this connection, as the connecting portions 35*b*, 35*d* cannot be shown in FIG. 9, only reference numerals 35*b*, 35*d* are written at positions adjacent to reference numerals 35*a*, 35*c*.

The terminal portions 41*a*, 41*b*, 36*b*, 36*d* on the positive electrode side are independently connected to the electric heat generating films 40 of the connecting portions 36*a*, 36*b*, 36*c*, 36*d* which are independently provided corresponding to the four regions (1) to (4).

The electric heat generating film 40 provided in the first region (1) is electrically connected to the first terminal portion 41*a* on the positive electrode side and the terminal portion 42 on the negative electrode side.

The electric heat generating film 40 provided in the second region (2) is electrically connected to the second terminal portion 41*b* on the positive electrode side and the terminal portion 42 on the negative electrode side. The electric heat generating film 40 provided in the third region (3) is electrically connected to the third terminal portion 41*c* on the positive electrode side and the terminal portion 42 on the negative electrode side. The electric heat generating film 40 provided in the fourth region (4) is electrically connected to the fourth terminal portion 41*d* on the positive electrode side and the terminal portion 42 on the negative electrode side.

In the boundary portion between the electric heat generating film 40 in the first region (1) and the electric heat generating film 40 in the second region (2) and also in the boundary portion between the electric heat generating film 40 in the third region (3) and the electric heat generating film 40 in the fourth region (4), portions in which no film 40 is provided (that is, portions composed of only resin) are respectively provided at regular intervals, so that the electrical continuation can be shut off at each boundary portion.

According to the above constitution, when the energization of voltage upon the first to the fourth terminal portion 41*a*, 41*b*, 41*c*, 41*d* on the positive electrode side is independently controlled by the output signals sent from the air conditioning control unit 43, the amount of heat generated by the electric heat generating films 40 in the first (1) to the fourth region (4) can be independently controlled. Therefore, when the immediately effective heating is being executed, the temperature of air blowing out from the first region (1) to the fourth region (4) of the heat exchanger 18 for heating can be independently controlled according to the preference of a passenger.

Figure 10:
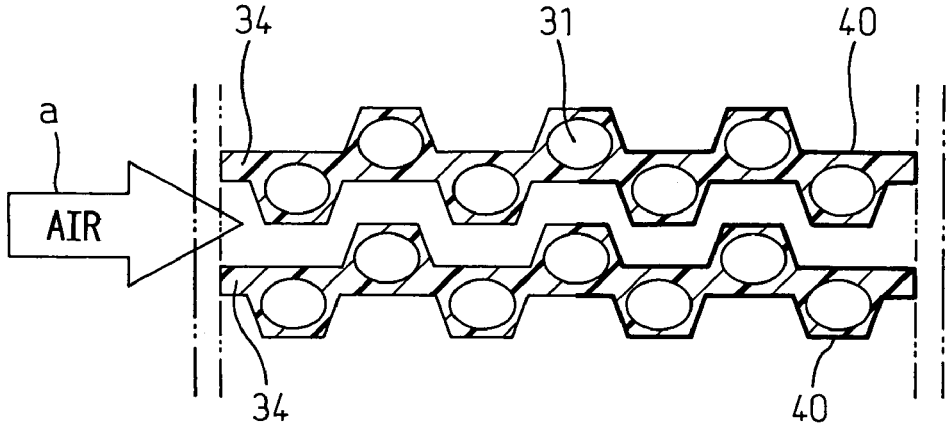
FIG. 10 is a sectional view showing a primary portion of the heat exchanger for heating of the fourth embodiment.

Next, the fourth embodiment will be explained below. In the fourth embodiment, the electric heat generating film 40 is not formed on all regions on the outer surface of the heat transfer plate member 34 of the heat exchange core portion 30 but the electric heat generating film 40 is formed only in one region on the outer surface of the heat transfer plate member 34 of the heat exchange core portion 30. FIG. 10 is a view showing a specific example of the fourth embodiment. As shown in FIG. 10, the electric heat generating film 40 is formed only in one region on the outer surface of the heat transfer plate member 34 on the downstream side in the air flow direction "a". In this case, the bold solid lines in FIG. 10 show a range in which the electric heat generating film 40 is formed. The range in which the electric heat generating film 40 is formed is also shown by the bold solid line in FIGS. 11 to 14 and FIGS. 16 to 21 described later.

Figure 11:
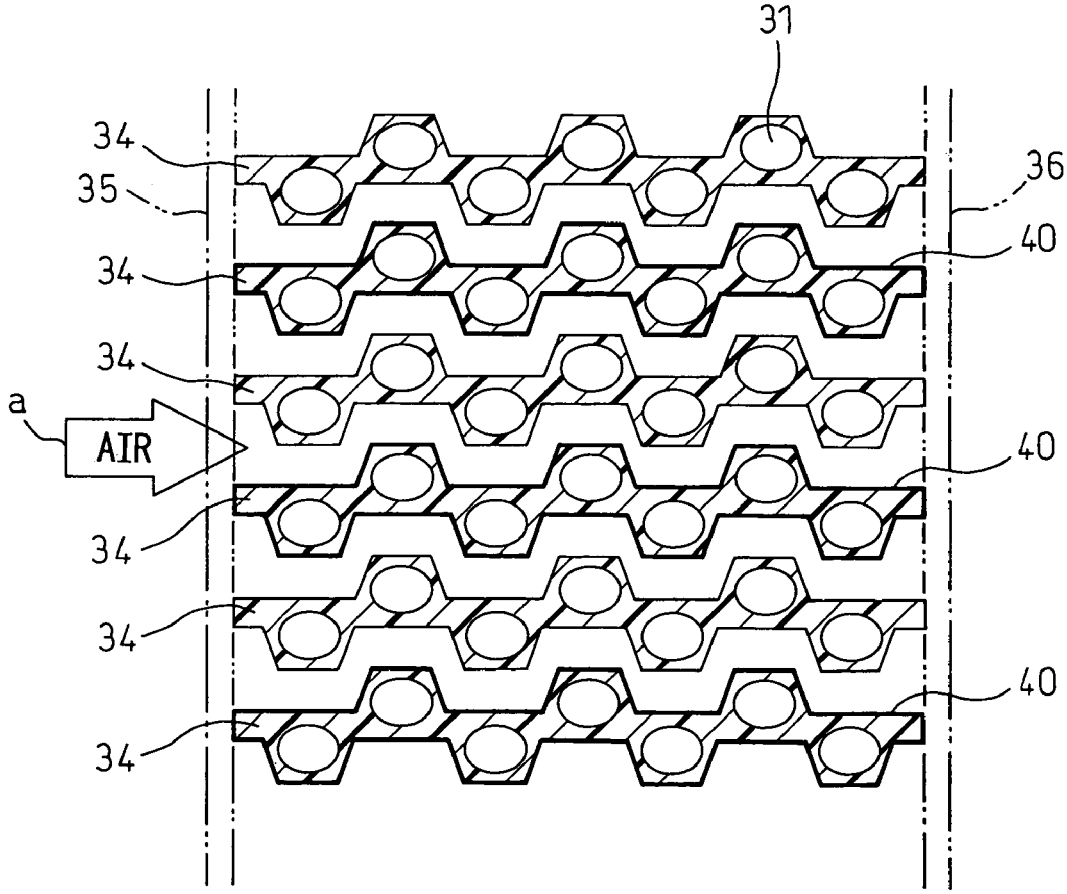
FIG. 11 is a sectional view showing a primary portion of the heat exchanger for heating of the fifth embodiment.

Next, the fifth embodiment will be explained below. In the fifth embodiment, in the large number of heat transfer plate members 34 of the heat exchange core portion 30, the electric heat generating film 40 is formed in the heat transfer plate members 34 located at predetermined intervals. FIG. 11 is a view showing a specific example of the fifth embodiment. In the large number of heat transfer plate members 34 of the heat exchange core portion 30, the electric heat generating film 40 is formed only on every other heat transfer plate member 34.

Like the fourth and the fifth embodiment, the electric heat generating film 40 may be partially formed only in one portion of the heat transfer plate member 34 according to the necessary amount of heat generation with respect to the overall size of the heat exchange core portion 30.

Figure 12:
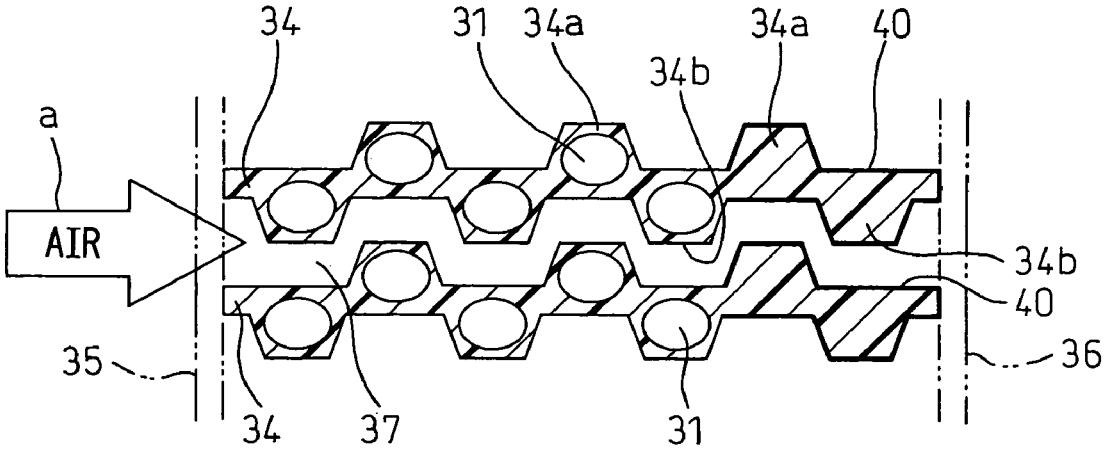
FIG. 12 is a sectional view showing a primary portion of the heat exchanger for heating of the sixth embodiment.

Next, the sixth embodiment will be explained below. The sixth embodiment is a variation in which the concept of the fourth and the fifth embodiment is further developed. As shown in FIG. 12, a region, in which only the protruding portions 34*a*, 34*b* are formed and the inner fluid passages 31 are abolished, is formed in one portion of the heat transfer plate member 34 on the downstream side in the air flow direction "a". The electric heat generating film 40 is formed in the region in which only these protruding portions 34*a*, 34*b* are formed.

Due to the above constitution, the electric heat generating film 40 is formed in a portion where the inner fluid flowing passages 32, in which hot water is flowing, are not located. Therefore, in the case where the immediately effective heating is executed, heat is not transmitted from the electric heat generating film 40 to the hot water. Accordingly, the immediately effective heating can be more effectively executed by the electric heat generating film 40.

Figure 13:
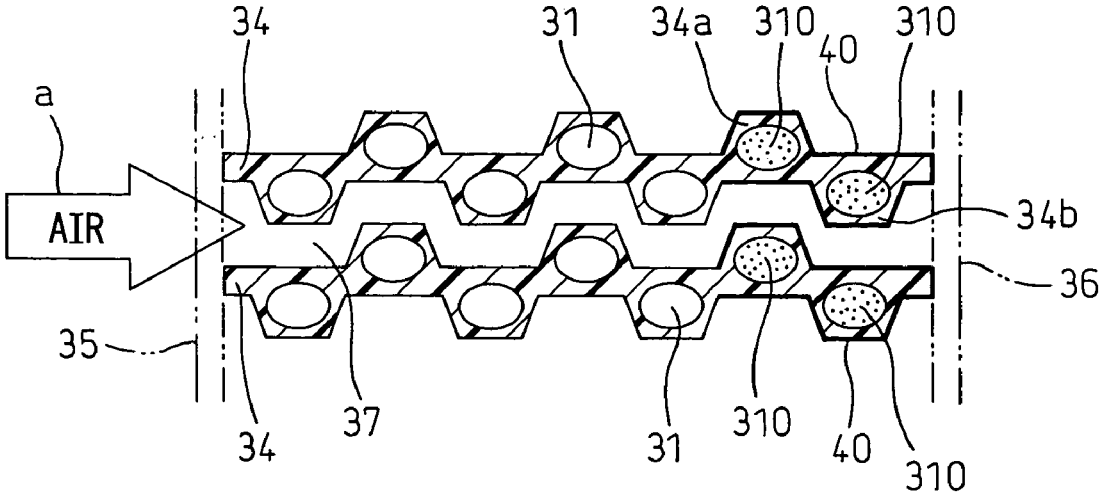
FIG. 13 is a sectional view showing a primary portion of the heat exchanger for heating of the seventh embodiment.

Next, the seventh embodiment will be explained below. FIG. 13 is a view showing the seventh embodiment, in which the sixth embodiment is varied as follows. Instead of the protruding portions 34*a*, 34*b* in which the inner fluid flowing passages 31 are abolished in the sixth embodiment, the protruding portions 34*a*, 34*b* having only the cavity portion 310 are formed in one region of the heat transfer plate member 34 on the downstream side in the air flow direction "a". The electric heat generating film 40 is formed only in portions in which these cavity portions 310 are formed.

In this case, the cavity portion 310 can be formed simultaneously with the extrusion of the heat transfer plate member 34. However, when both end portions of the cavity portion 310 are closed after the completion of extrusion, it is possible to prevent hot water from flowing into the cavity portion 310. Accordingly, in this seventh embodiment, when the immediately effective heating is executed, heat is not transmitted from the electric heat generating film 40 to hot water. Therefore, the immediately effective heating can be effectively executed.

Figure 14:
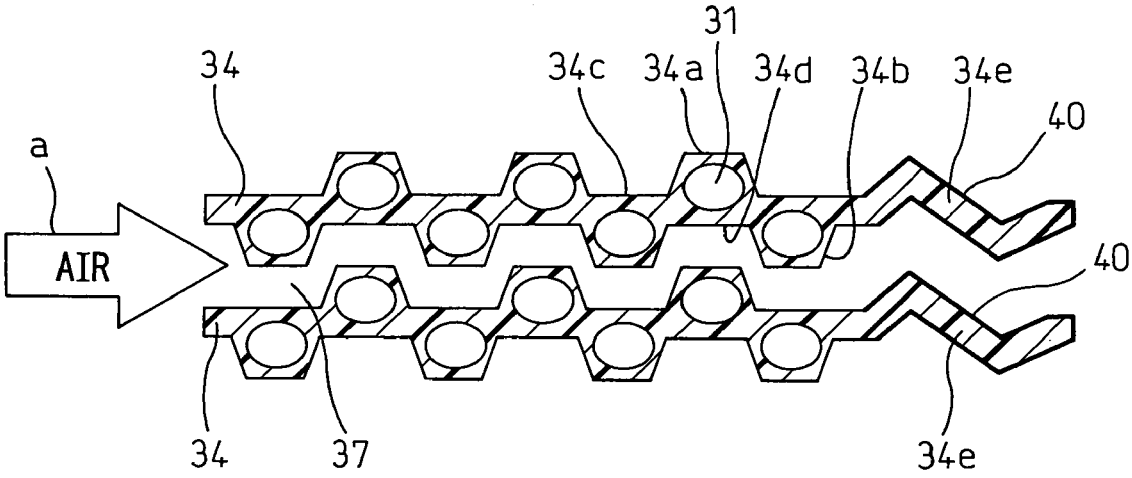
FIG. 14 is a sectional view showing a primary portion of the heat exchanger for heating of the eighth embodiment.

Next, the eighth embodiment will be explained below. In the sixth embodiment, both the protruding portions 34*a*, 34*b*, in which the inner fluid passage 31 is provided, and the protruding portions 34*a*, 34*b*, in which the inner fluid passage 31 is not provided, are formed into a protruding shape (trapezoidal shape). However, in the eighth embodiment, as shown in FIG. 14, the wave-shaped bent portion 34*e*, in which the inner fluid passage 31 is not provided, is formed in a region of the heat transfer plate member 34 on the downstream side in the air flow direction "a", and the electric heat generating film 40 is formed only in this wave-shaped bent portion 34*e*.

Due to the above constitution, in the same manner as that of the sixth and the seventh embodiment, when the immediately effective heating is conducted, heat is not transmitted from the electric heat generating film 40 to hot water. Therefore, the immediately effective heating can be effectively executed. In this connection, a turbulent flow is generated by the wave-shaped bent portion 34*e* in the same manner as that of the trapezoidal protruding portions 34*a*, 34*b*, and the heat transfer coefficient on the air side can be enhanced.

Next, the ninth embodiment will be explained below. In the first to the eighth embodiment described above, explanations are made into the heat exchanger 18 for heating in which the inner fluid passage 31, in which hot water flows, is formed in the heat transfer plate member 34. However, the ninth embodiment relates to an auxiliary heat exchanger for heating in which the inner fluid passage 31, in which hot water flows, is not formed in the heat transfer plate member 34.

Figure 15:
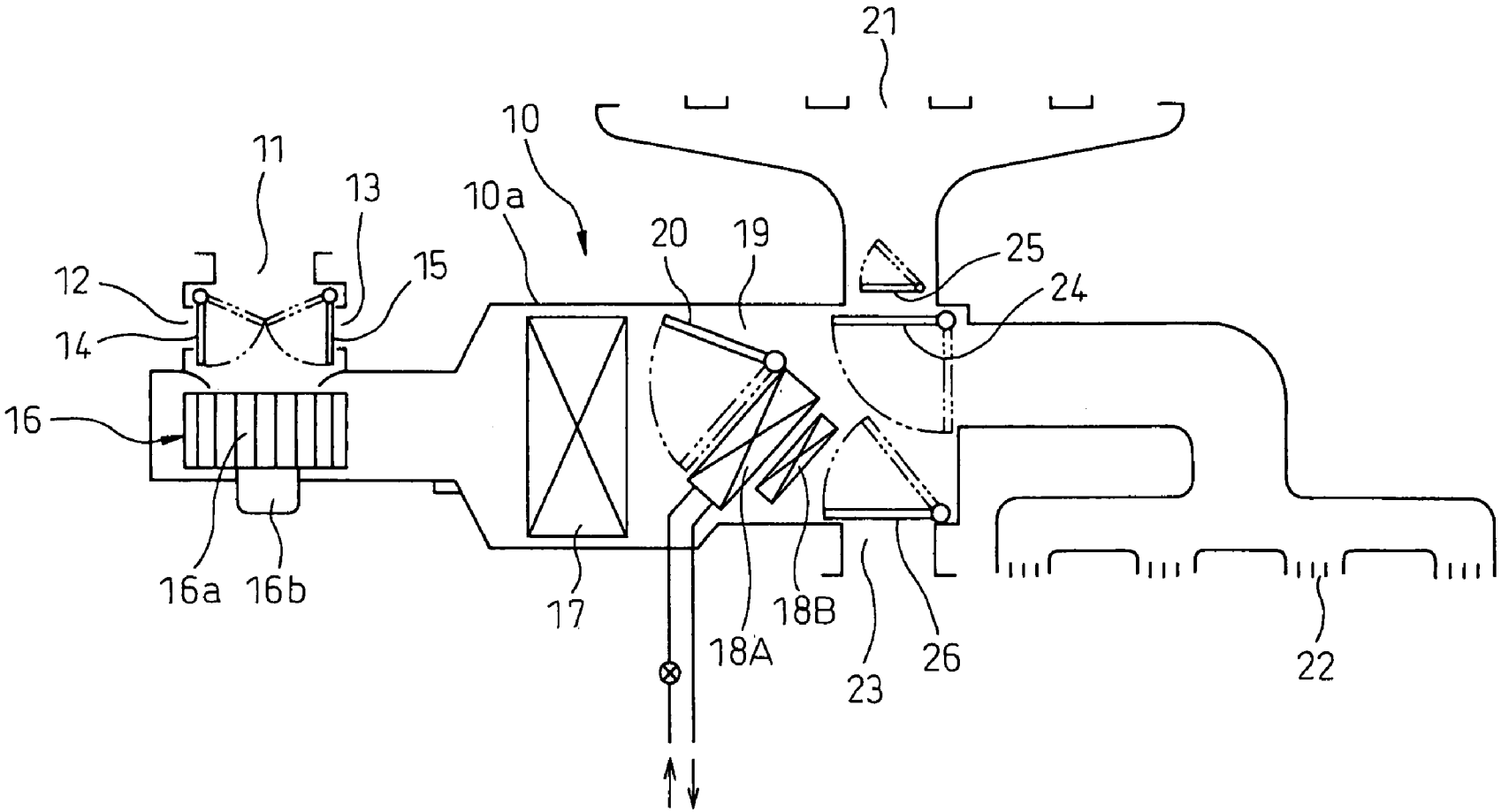
FIG. 15 is a sectional view showing an outline of the interior air conditioning unit of the air conditioning unit for vehicle use to which the ninth embodiment is applied.

First, referring to FIG. 15, the interior air conditioning unit 10 of the air conditioner for vehicle use provided with the above auxiliary heat exchanger for heating will be explained as follows. FIG. 15 is a view corresponding to FIG. 1. Concerning the heat exchanger for heating, both the well-known hot water type main heat exchanger 18A for heating, in which air is heated by a heat source of hot water, and the auxiliary heat exchanger 18B for heating of the ninth embodiment are jointly used. The auxiliary heat exchanger 18B for heating of the ninth embodiment is arranged in a portion right after air has been blown out from the hot water type main heat exchanger 18A for heating. Except for the above points, the structure shown in FIG. 15 is the same as that shown in FIG. 1. Therefore, explanations are omitted here.

Figure 16:
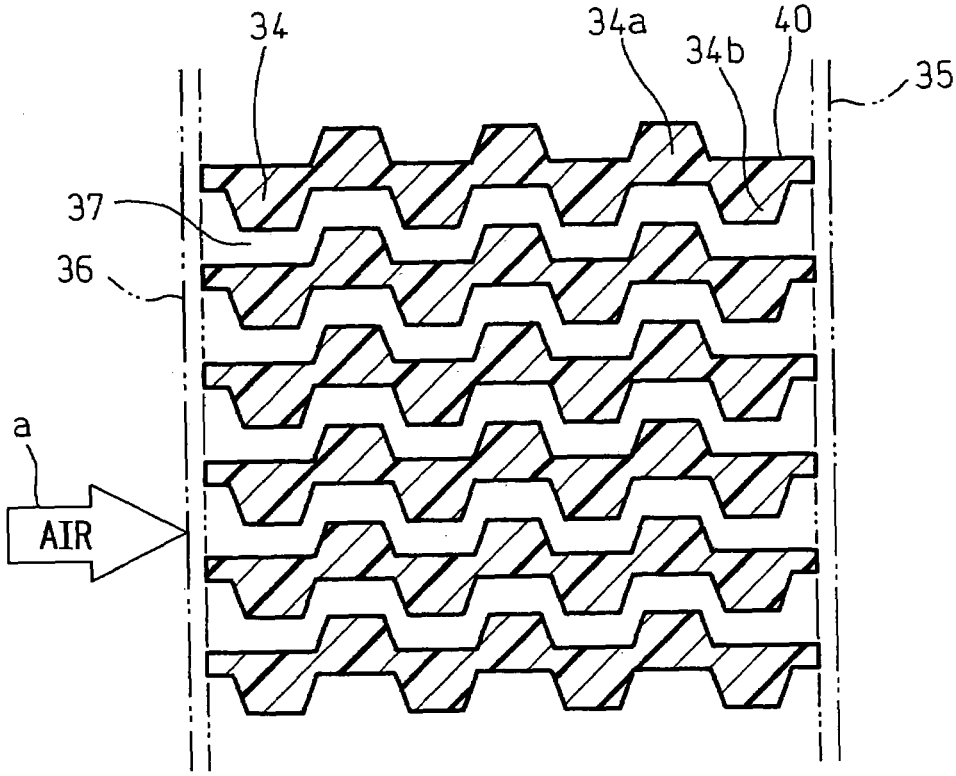
FIG. 16 is a sectional view showing a primary portion of the heat exchanger for heating of the ninth embodiment.

Next, FIG. 16 is a view showing the structure of the heat transfer plate member 34 of the auxiliary heat exchanger 18B for heating of the ninth embodiment. All the inner fluid passages 31 provided in the heat transfer plate member 34 shown in FIG. 3 are abolished, and the heat transfer plate member 34 is composed of a solid plate-shaped member made of resin having the protruding portions 34*a*, 34*b*. The electric heat generating film 40 is formed on a surface of this solid plate-shaped member made of resin.

In the auxiliary heat exchanger 18B for heating, the connecting portions 35, 36 are arranged at the front and the rear end portion in the air flow direction of the heat transfer plate members 34 so that the heat transfer plate members 34 can be integrally connected to each other. In the same manner as that shown in FIG. 2, the positive electrode side terminal portion 41 and the negative electrode side terminal portion 42 are electrically connected to the electric heat generating films 40 on these connecting portions 35, 36. This point of the structure is the same as that of the first embodiment.

According to the ninth embodiment, air, which has passed in the hot water type main heat exchanger 18A for heating, passes in the air passage 37 formed between the heat transfer plate members 34 of the auxiliary heat exchanger 18B for heating. Accordingly, when the temperature of hot water is low, the electric heat generating film 40 is heated when an electric current is made to flow in the electric heat generating film 40, so that air passing in the air passage 37 can be heated. Due to the foregoing, when the temperature of hot water is low, the passenger compartment can be immediately heated by the heat generated on the electric heat generating film 40.

In this case, no heat is transmitted from the electric heat generating film 40 to hot water. Therefore, the immediately effective heating can be effectively performed. As a turbulent flow is generated by the protruding and recessing shape of the protruding portions 34*a*, 34*b* of the heat transfer plate members 34, the heat transfer coefficient on the surface of each heat transfer plate member 34 can be enhanced. Therefore, air passing in the air passage 37 can be effectively heated.

According to the ninth embodiment, the inner fluid passages 31, in which hot water flows, are not provided in the auxiliary heat exchanger 18B for heating. That is, the auxiliary heat exchanger 18B for heating is exclusively heated by electricity. Therefore, the auxiliary heat exchanger 18B for heating can be arranged at any position without giving consideration to the connection of the auxiliary heat exchanger 18B for heating to the hot water piping. Therefore, the structure of the ninth embodiment is advantageous in that the degree of freedom of selecting a position in which the heat exchanger is arranged can be enhanced.

Figure 17:
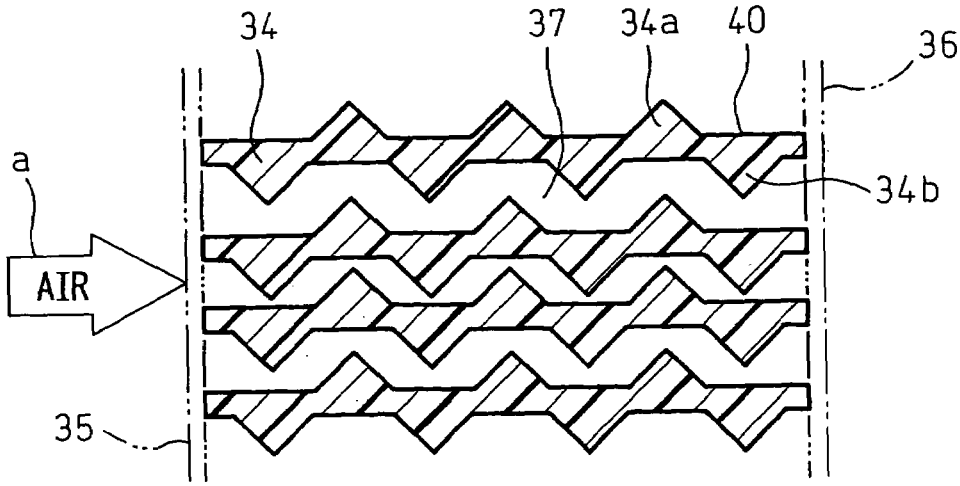
FIG. 17 is a sectional view showing a primary portion of the variation of the heat exchanger for heating of the ninth embodiment.
Figure 18:
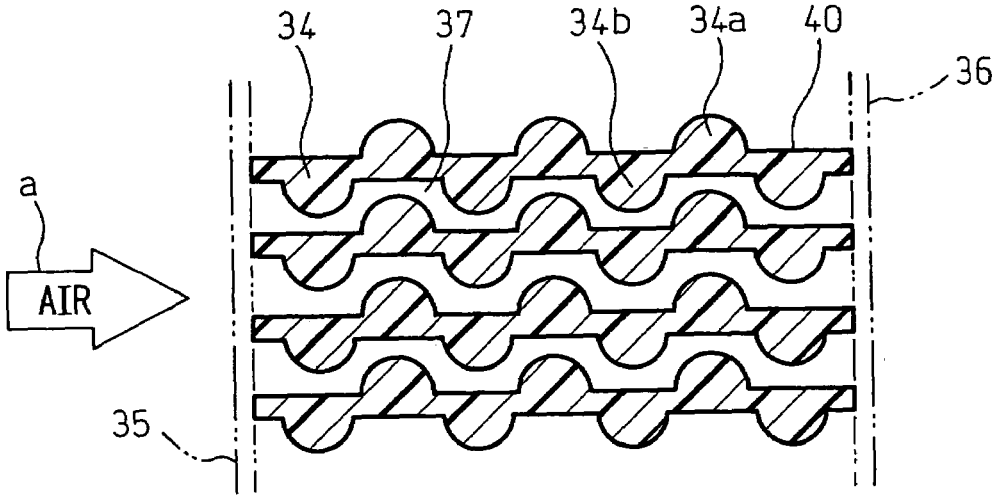
FIG. 18 is an exploded perspective view showing a variation of the heat exchanger for heating of the ninth embodiment.

In the auxiliary heat exchanger 18B for heating of the ninth embodiment, the inner fluid passages 31, in which hot water flows, are not provided. Therefore, the cross sectional shape of the protruding portion 34*a*, 34*b* of the heat transfer plate member 34 is not limited to the trapezoidal shape shown in FIG. 16, but the cross sectional shape of the protruding portion 34*a*, 34*b* of the heat transfer plate member 34 can be variously changed. For example, the cross sectional shape of the protruding portion 34*a*, 34*b* may be triangular as shown in FIG. 17. Alternatively, the cross sectional shape of the protruding portion 34*a*, 34*b* may be semicircular as shown in FIG. 18.

Figure 19:
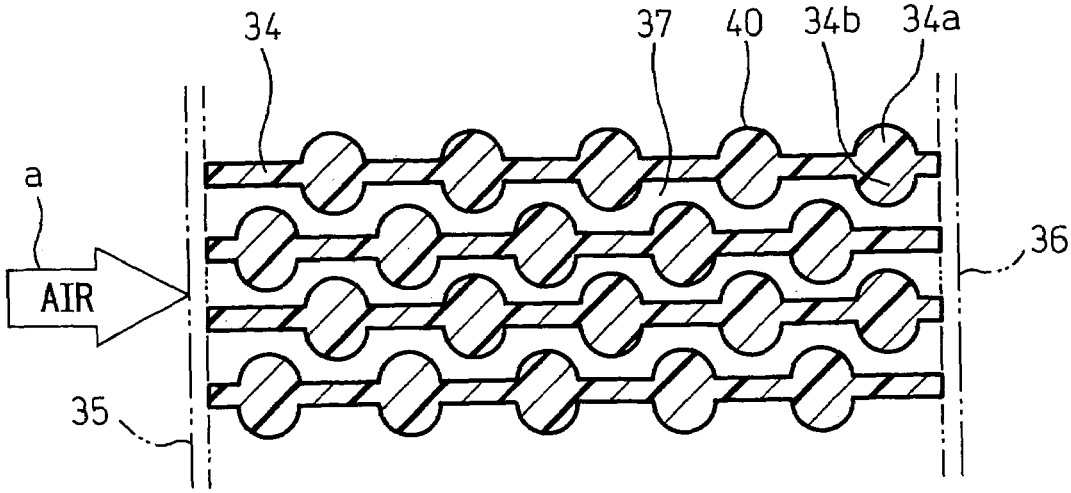
FIG. 19 is a sectional view showing a primary portion of the variation of the heat exchanger for heating of the ninth embodiment.

As shown in FIG. 19, the following structure may be adopted. Semicircular protruding portions 34*a*, 34*b* are formed at the same positions on both sides of the heat transfer plate member 34 in the air flow direction "a". Positions of the protruding portions 34*a*, 34*b* of the heat transfer plate member 34 are shifted from positions of the adjacent protruding portions 34*a*, 34*b* of the heat transfer plate member 34, so that the protruding portions 34*a*, 34*b* of one heat transfer plate member 34 can be located in recessed portions between the protruding portions 34*a*, 34*b* of the other heat transfer plate member 34. In the variation shown in FIG. 19, naturally, the cross-sectional shape of the protruding portions 34*a*, 34*b* may be trapezoidal as shown in FIG. 16, and the cross-sectional shape of the protruding portions 34*a*, 34*b* may be triangular as shown in FIG. 17.

Figure 20:
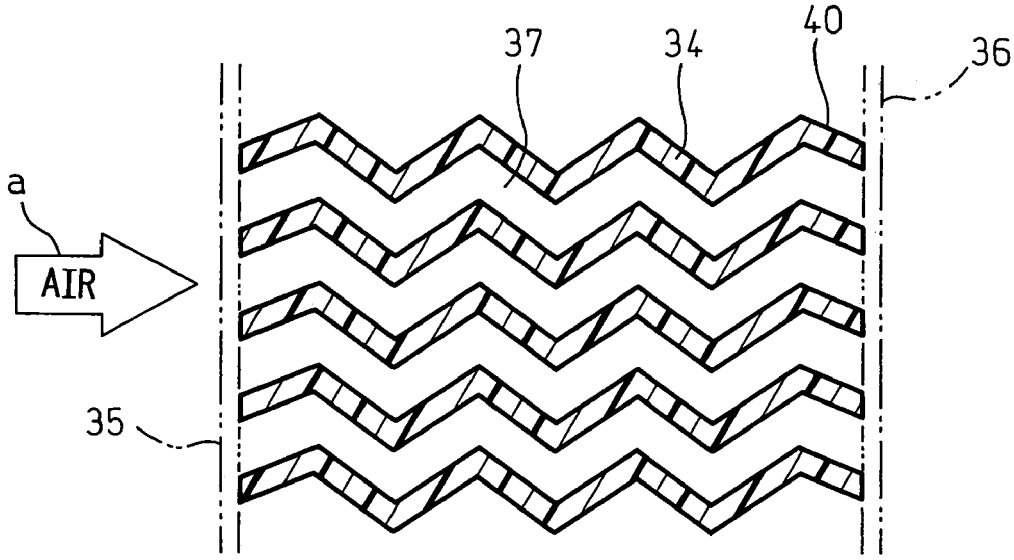
FIG. 20 is a sectional view showing a primary portion of the variation of the heat exchanger for heating of the ninth embodiment.

FIG. 20 is a view showing another variation of the ninth embodiment. In this variation, the protruding portions 34*a*, 34*b* are not provided in the heat transfer plate member 34, but the entire heat transfer plate member 34 is repeatedly bent being formed into a wave-shape. In other words, the variation shown in FIG. 20 corresponds to a case in which the wave-shaped bent portion 34*e* shown in FIG. 14 is applied to the entire heat transfer plate member 34.

Figure 21:
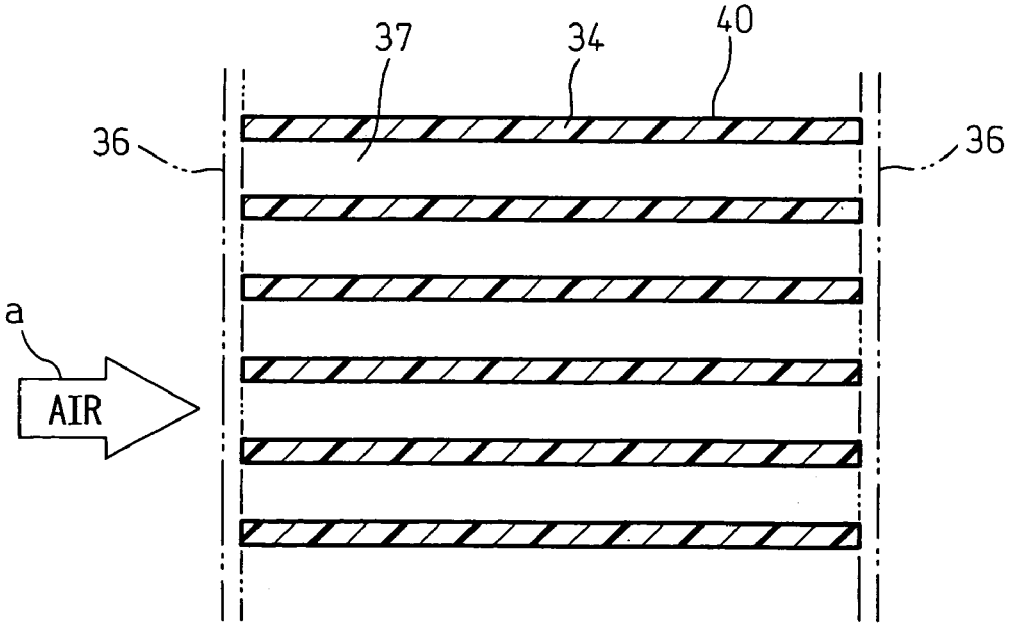
FIG. 21 is a sectional view showing a primary portion of the variation of the heat exchanger for heating of the ninth embodiment.

Further, FIG. 21 is a view showing a variation in which the heat transfer plate member 34 is formed into a simple flat shape. In this variation, the air passage 37 provided between the heat transfer plate members 34 is formed into a linear shape. Therefore, it is impossible to positively generate a turbulent flow of air in the air passage 37. However, the characteristic of the heat exchanger, in which the electric heat generating film 40 is directly formed on the surface of the heat transfer plate member 34 made of resin, can be also exhibited in the variation shown in FIG. 21.

Finally, another embodiment will be explained below. A fluid for heating, which passes in the inner fluid passage 31, is not limited to hot water. For example, oil at high temperature may be used as the fluid for heating.

The use of the heat exchanger for heating of the present invention is not limited to the use of the air conditioner incorporated into a vehicle. It is possible to apply the heat exchanger for heating of the present invention to various equipment.

While the invention has been described by reference to specific embodiments chosen for purposes of illustration, it should be apparent that numerous modifications could be made thereto by those skilled in the art without departing from the basic concept and scope of the invention.

The invention claimed is:

1. A heat exchanger for heating comprising:

a plurality of heat transfer plate members (34) arranged in parallel with each other at predetermined intervals; and connecting portions (35, 36) for integrally connecting the plurality of heat transfer plate members (34) to each other, wherein air passages (37) are formed between the plurality of heat transfer plate members (34), inner fluid passages (31) are formed in the heat transfer plate members (34), fluid for heating air, which passes in the air passages (37), flows in the inner fluid passages (31), and an electric heat generating film (40) for heating the air, which passes in the air passages (37), by energizing is formed on surfaces of the plurality of heat transfer plate members (34).

2. A heat exchanger for heating according to claim 1, wherein the heat transfer plate members (34) and the connecting portions (35, 36) are formed of an electrically insulating material by means of integral molding.

3. A heat exchanger for heating according to claim 1, wherein each heat transfer plate member (34) includes protruding portions (34*a*, 34*b*) which protrude from both faces of the heat transfer plate member (34), the inner fluid passages (31) are formed inside the protruding portions (34*a*, 34*b*), the protruding portions (34*a*, 34*b*) and the inner fluid passages (31) are formed in a direction perpendicular to the air flow direction (a) of the air passages (37), a plurality of protruding portions (34*a*, 34*b*) and inner fluid passages (31) are formed being arranged in the air flow direction (a), and the air passages (37) are formed into a meandering shape by the protruding portions (34*a*, 34*b*).

4. A heat exchanger for heating according to claim 3, wherein the air passages (37) are formed into a meandering shape when the protruding portions (34*a*, 34*b*) protrude in the lateral direction with respect to the air flow direction.

5. A heat exchanger for heating according to claim 1, wherein the electric heat generating film (40) is formed in all regions on the heat transfer plate member (34) in the air flow direction (a).

6. A heat exchanger for heating according to claim 1, wherein the electric heat generating film (40) is formed only in a region of the heat transfer plate member (34) in the air flow direction (a).

7. A heat exchanger for heating according to claim 1, wherein a region, in which the inner fluid passages (31) are not formed, is provided in a portion of the heat transfer plate member (34) in the air flow direction (a), and the electric heat generating film (40) is formed only in a region of the heat transfer plate member (34) in which the inner fluid passages (31) are not formed.

8. A heat exchanger for heating according to claim 1, wherein a large number of heat transfer plate members (34) are arranged in parallel to each other, and the electric heat generating film (40) is formed on surfaces of the heat transfer plate members (34) arranged at predetermined intervals.

9. A heat exchanger for heating according to claim 1, wherein the wall thickness of the heat transfer plate member (34) in the periphery of the inner fluid passage (31) is 0.1 to 0.4 mm, and the heat conductivity of the electrically insulating material is 0.6 to 10 W/mK.

10. A heat exchanger for heating comprising:

a plurality of heat transfer plate members (34) arranged in parallel with each other at predetermined intervals; and connecting portions (35, 36) for integrally connecting the plurality of heat transfer plate members (34) to each other, wherein the heat transfer plate members (34) and the connecting portions (35, 36) are formed of an electrically insulating material by means of integral molding, the air passages (37) are formed between the plurality of heat transfer plate members (34), the heat transfer plate members (34) are formed into a solid plate-shape, and an electric heat generating film (40) for heating the air, which passes in the air passages (37), by energizing is formed on surfaces of the plurality of heat transfer plate members (34).

11. A heat exchanger for heating according to claim 2, wherein the electrically insulating material is made of resin, the heat resisting property of which is capable of withstanding a temperature of the electric heat generating film (40) to be heated.

12. A heat exchanger for heating according to claim 1, wherein at least two connecting members (35, 36) are arranged for the plurality of heat transfer plate members (34), the electric heat generating film (40) is continuously formed on a surface from the plurality of heat transfer plate members (34) to at least two connecting portions (35, 36), and the terminal portions (41, 41*a* to 41*d*, 42) for energizing the electric heat generating film (40) are connected to the electric heat generating film (40) on at least two connecting portions (35, 36).

13. A heat exchanger for heating according to claim 1, wherein the electric heat generating film (40) is formed on surfaces of the plurality of heat transfer plate members (34) being divided into a plurality of regions, and the electric heat generating films (40) provided on the plurality of regions are respectively controlled capable of being independently energized.

14. A heat exchanger for heating according to claim 1, further comprising:

a temperature detection means (44*a*) for detecting a surface temperature of the electric heat generating film (40); and a control means (43) for controlling an electric current supplied to the electric heat generating film (40) according to the detection temperature detected by the temperature detection means (44*a*).

15. An air conditioner for vehicle use comprising a heat exchanger for heating according to claim 1, wherein the fluid for heating is hot water supplied from a hot water source mounted on a vehicle, and the electric heat generating film (40) is energized when the temperature of the hot water is not more than a predetermined temperature.

16. An air conditioner for vehicle use comprising:

a primary heat exchanger (18A) for heating while hot water supplied from a hot water source mounted on a vehicle is being used as a heat source, and an auxiliary heat exchanger (18B) for heating, which is arranged on the downstream side of the air flow of the primary heat exchanger (18A) for heating, for heating air which has passed through the primary heat exchanger (18A) for heating, wherein the auxiliary heat exchanger (18B) for heating is composed of a heat exchanger for heating according to claim 10, and the electric heat generating film (40) is energized when the temperature of the hot water is not more than a predetermined temperature.

* * * * *